US006923242B2

(12) United States Patent
Nakao et al.

(10) Patent No.: US 6,923,242 B2
(45) Date of Patent: Aug. 2, 2005

(54) ALUMINUM CASTING METHOD

(75) Inventors: Yasuhiro Nakao, Sayama (JP); Hiroto Shoji, Sayama (JP); Kunitoshi Sugaya, Sayama (JP); Takashi Kato, Sayama (JP); Takaharu Echigo, Sayama (JP); Satoshi Matsuura, Sayama (JP); Kenichi Kawasaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/485,538

(22) PCT Filed: Jun. 27, 2002

(86) PCT No.: PCT/JP02/06481

§ 371 (c)(1),
(2), (4) Date: Feb. 2, 2004

(87) PCT Pub. No.: WO03/013764

PCT Pub. Date: Feb. 20, 2003

(65) Prior Publication Data

US 2004/0206469 A1 Oct. 21, 2004

(30) Foreign Application Priority Data

Aug. 3, 2001 (JP) ..... 2001-236811

(51) Int. Cl.[7] ..... B22D 27/00

(52) U.S. Cl. ..... 164/72; 164/267; 164/67.1; 164/259

(58) Field of Search ..... 164/72, 267, 67.1, 164/259

(56) References Cited

U.S. PATENT DOCUMENTS 5,039,435 A * 8/1991 Hanano ..... 106/38.22
6,722,417 B2 * 4/2004 Ban et al. ..... 164/56.1

FOREIGN PATENT DOCUMENTS

| | | |
|---|---|---|
| EP | 1 145 787 A1 | 10/2001 |
| JP | 2000-280063 | 10/2000 |
| JP | 2001-321921 | 11/2001 |
| JP | 2001-353567 | 12/2001 |
| JP | 2002-028770 | 1/2002 |
| JP | 2002-028771 | 1/2002 |

* cited by examiner

*Primary Examiner*—Jonathan Johnson
*Assistant Examiner*—I.-H. Lin
(74) *Attorney, Agent, or Firm*—Rankin, Hill, Porter & Clark LLP

(57) ABSTRACT

An aluminum casting method includes the step of applying in advance a mold release agent including magnesium to a mold surface. Thereafter, a nitrogen gas is injected into a cavity to cause reaction between the magnesium in the surface of the mold release agent and the nitrogen gas, thereby forming magnesium nitride. Since the nitrogen gas reacts only with the magnesium exposed in the surface of the mold release agent, the forming time of the magnesium nitride is reduced and also the amount of nitrogen gas used is reduced.

9 Claims, 24 Drawing Sheets

ALUMINUM CASTING METHOD

CROSS-REFERENCE TO RELATED APPLICATION

This application is a 371 of PCT/JP02/06481 filed on Jun. 27, 2002.

TECHNICAL FIELD

The present invention relates to an aluminum casting method of supplying molten aluminum to a mold cavity to make aluminum casts.

BACKGROUND ART

During aluminum casting, an oxide film can be formed on the surface of molten aluminum supplied to a mold cavity. The formed oxide film can increase the surface tension of the molten aluminum and reduce the fluidity of the molten aluminum. The formation of an oxide film on the surface of molten aluminum thus makes it difficult to maintain the molten aluminum in good runnability.

As a casting method of maintaining molten aluminum in good runnability during aluminum casting, an "Aluminum Casting Method" disclosed in Japanese Patent Laid-Open Publication No. 2000-280063, for example, has been presented. This aluminum casting method is illustrated in FIGS. 24 and 25.

In FIG. 24, for the casting of aluminum, a nitrogen ($N_2$) gas is first charged from a nitrogen gas cylinder 15 into a cavity 152 within a mold 151. Then, a nitrogen gas is sent into a tank 153. Magnesium powder (Mg powder) in the tank 153 is fed into a heating furnace 155 with the nitrogen gas. The magnesium powder is sublimated in the heating furnace 155. The sublimated magnesium is reacted with the nitrogen gas to form a magnesium-nitrogen compound ($Mg_3N_2$). The magnesium-nitrogen compound is injected via a pipe 156 into the cavity 152 within the mold 151. The injected magnesium-nitrogen compound is deposited on the surface of the cavity 152.

Next, molten aluminum 157 is supplied to the cavity 152. The supplied molten aluminum 157 is reacted with the magnesium-nitrogen compound to remove oxygen from oxides on the surface of the molten aluminum 157. This prevents the formation of an oxide film on the surface of the molten aluminum 157, suppressing increase in the surface tension of the molten aluminum 157. The running of the molten aluminum 157 into the cavity 152 is thus maintained in good conditions to increase the quality of aluminum casts.

Now the above-described steps of generating a magnesium-nitrogen compound and pouring molten aluminum will be described in detail.

First, the step of forming a magnesium-nitrogen compound will be described. Magnesium powder is sublimed in the heating furnace 155. The sublimed magnesium is reacted with a nitrogen gas within the heating furnace 155. Since the sublimed magnesium floats within the heating furnace 155, the nitrogen gas attaches to the entire surface of the magnesium, forming a magnesium-nitrogen compound on the entire surface.

Next, the step of pouring molten aluminum will be described with reference to FIG. 25.

A magnesium-nitrogen compound layer 159 is deposited on the surface of the cavity 152. Then the molten aluminum 157 is supplied to the cavity 152. The supply of the molten aluminum 157 to the cavity 152 brings a surface 157*a* of the molten aluminum 157 into contact with a surface 159*a* of the magnesium-nitrogen compound layer 159 for reduction to remove oxygen from an oxide 157*b* formed in the surface 157*a* of the molten aluminum 157.

Thus bringing the surface 157*a* of the molten aluminum 157 into contact with the surface 159*a* of the magnesium-nitrogen compound layer 159 removes oxygen from the oxide 157*b* formed in the surface 157*a* of the molten aluminum 157. This reveals that only the existence of the surface 159*a* of the magnesium-nitrogen compound layer 159 with which the surface 157*a* of the molten aluminum 157 is contacted is required to remove oxygen from the oxide 157*b* formed in the surface 157*a* of the molten aluminum 157.

However, as described with FIG. 24, the production of a magnesium-nitrogen compound is performed with magnesium floating within the heating furnace 155, so that the nitrogen gas attaches to the entire surface of the magnesium. The magnesium-nitrogen compound is thus produced on the entire surface of the magnesium. The magnesium-nitrogen compound deposited on the surface of the cavity 152 results in the magnesium-nitrogen compound layer 159 with film thickness t as shown in FIG. 25. This means the excessive deposition of the magnesium-nitrogen compound layer 159 on the surface of the cavity 152, resulting in time-taking formation of the magnesium-nitrogen compound layer 159, and preventing increase in productivity. Further, the excessive formation of the magnesium-nitrogen compound layer 159 results in an increase in the amount of nitrogen gas used, preventing cost reduction.

Furthermore, the above casting method adopts a method including the step of charging a nitrogen gas into the cavity. 152 with air left within the cavity 152 prior to the step of forming the magnesium-nitrogen compound layer 159 on the surface of the cavity 152. It is thus difficult to smoothly release air from the inside of the cavity 152. It therefore takes time to produce a nitrogen-gas atmosphere within the cavity 152, preventing increase in productivity.

It is thus desired to form a magnesium-nitrogen compound in a short period of time and reduce the amount of a nitrogen gas used.

DISCLOSURE OF THE INVENTION

According to the present invention, there is provided an aluminum casting method, which comprises the steps of: applying a mold release agent including magnesium to a mold surface to form a cavity; forming a cavity with the mold surface to which the mold release agent is applied; injecting a nitrogen gas into the cavity to react the nitrogen gas with magnesium, thereby forming magnesium nitride on the mold surface; and supplying molten aluminum into the cavity in which the magnesium nitride is formed with the surf ace of the molten aluminum being reduced by the magnesium nitride, to make an aluminum casting inside the cavity.

To form magnesium nitride, the mold release agent including magnesium is first applied to the mold surface and then a nitrogen gas is injected into the cavity. Magnesium in the surface of the mold release agent reacts with the nitrogen gas, forming the magnesium nitride. The nitrogen gas is thus reacted only with the magnesium exposed in the surface of the mold release layer, of all the magnesium included in the mold release layer. This allows reduction in the forming time of the magnesium nitride. In addition, the reaction of the nitrogen gas only with the magnesium exposed in the surface of the mold release layer allows the formation of the magnesium nitride, reducing the amount of the nitrogen gas used.

As another example of attaching magnesium to the mold surface, heating and sublimating magnesium and injecting the sublimated gaseous magnesium into the cavity to deposit the gaseous magnesium on the mold surface may be conceived.

This method, however, requires a heating device for sublimating the magnesium and also a gas injecting device for injecting the sublimated gaseous magnesium into the cavity using, e.g., an inert gas for the injection of the gaseous magnesium. This increases the cost of equipment, preventing reduction in cast cost.

In this context, the present invention applies the mold release agent including magnesium to the mold. This eliminates the need for a heating device for sublimating magnesium and a gas injecting device for injecting gaseous magnesium into the cavity.

During casting, the application of a mold release agent to the mold surface so as to release a casting from the mold at the completion of the casting process is a general operation step. This application step can be utilized to apply magnesium to the mold surface, eliminating the need for adding a new step of applying magnesium to the mold surface. This allows simplification of the casting process.

As the mold release agent used in this invention, an oil-based mold release agent is used. The use of, e.g., a water-based mold release agent causes magnesium included in the mold release agent to react with water (oxygen) in the mold release agent, forming magnesium oxide. This prevents the subsequent injection of a nitrogen gas into the cavity from forming magnesium nitride and reducing the surface of the molten aluminum. Thus an oil-based mold release agent is used in this invention to prevent reaction between magnesium and water (oxygen). This allows the formation of magnesium nitride by the injection of a nitrogen gas into the cavity and the reduction of the surface of the molten aluminum with the magnesium nitride, maintaining the molten aluminum in good fluidity.

The content of magnesium included in the mold release agent is preferably about 2 wt % to 20 wt %. The magnesium content less than 2 wt % leads to poor reaction with the nitrogen gas. For good reaction, it is required to heat the mold or the nitrogen gas to 500° C. or more, resulting in longer heating time. This increases the cycle time of the casting process, reducing the productivity. For this reason, the magnesium content is set at about 2 wt % or more to lower the heating temperature of the mold or the nitrogen gas, reducing the cycle time of the casting process, and thereby increasing the productivity. The magnesium content exceeding 20 wt % may cause the generation of excessive reaction heat during the formation of magnesium nitride by the reaction of the nitrogen gas with magnesium. The atmosphere may thus become 700° C. or more, reducing the durability of the mold. The magnesium content is therefore set at less than 20 wt % so as to lower the reaction heat and increase the durability of the mold. The magnesium content is more preferably about 5 wt % to 10 wt %.

This invention only requires the application of the mold release agent at least to an area of the mold surface which causes poor runnability. Since the molten aluminum is a kind of viscous fluid, a path with a small section area or a path with cross section of a small vertical or lateral dimension reduces the fluidity and worsens the runnability. The cavity inevitably has an area causing poor runnability. The application of the mold release agent only to an area causing poor runnability provides the formation of magnesium nitride in this area. When the molten aluminum reaches the area of poor runnability, the surface of the molten aluminum can be brought into contact with the magnesium nitride. On the surface of the molten aluminum, an oxide may be formed. If the oxide is formed, reaction between the oxide and the magnesium nitride allows the removal of oxygen from the oxide. This prevents the formation of an oxide film on the surface of the molten aluminum, avoiding an increase in the surface tension of the molten aluminum. The area of poor runnability thus also allows maintenance of the molten aluminum in good runnability. Applying the mold release agent only to the area of poor runnability, reacting the nitrogen gas with the magnesium in the mold release agent, and thereby forming magnesium nitride only in this area allow a further reduction in the amount of nitrogen used.

Molten aluminum 39 is supplied to the cavity and then the plunger 35 pressurizes the molten aluminum 39 so as to form an aluminum casting inside the cavity.

Figure 20:
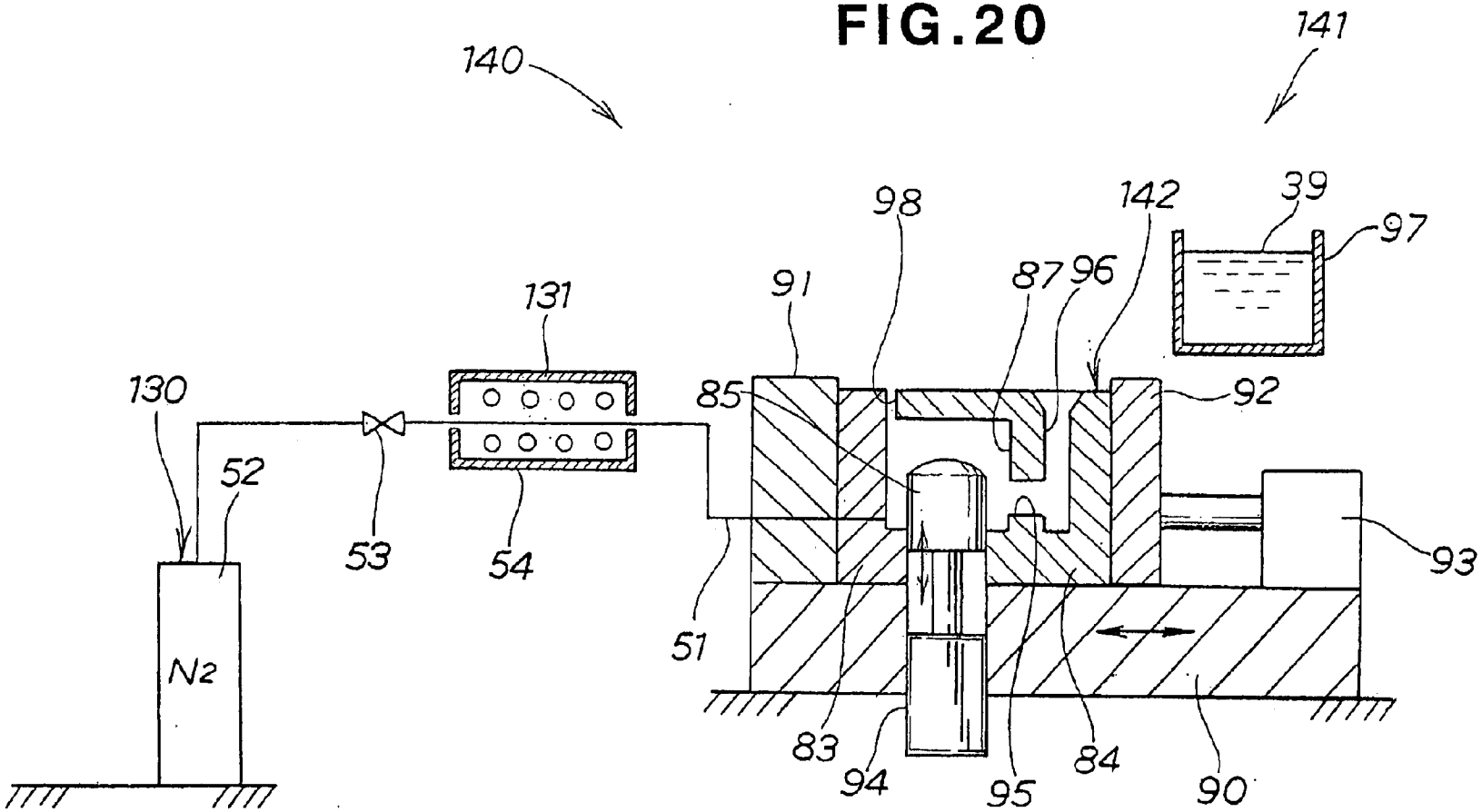
Figure 21A:
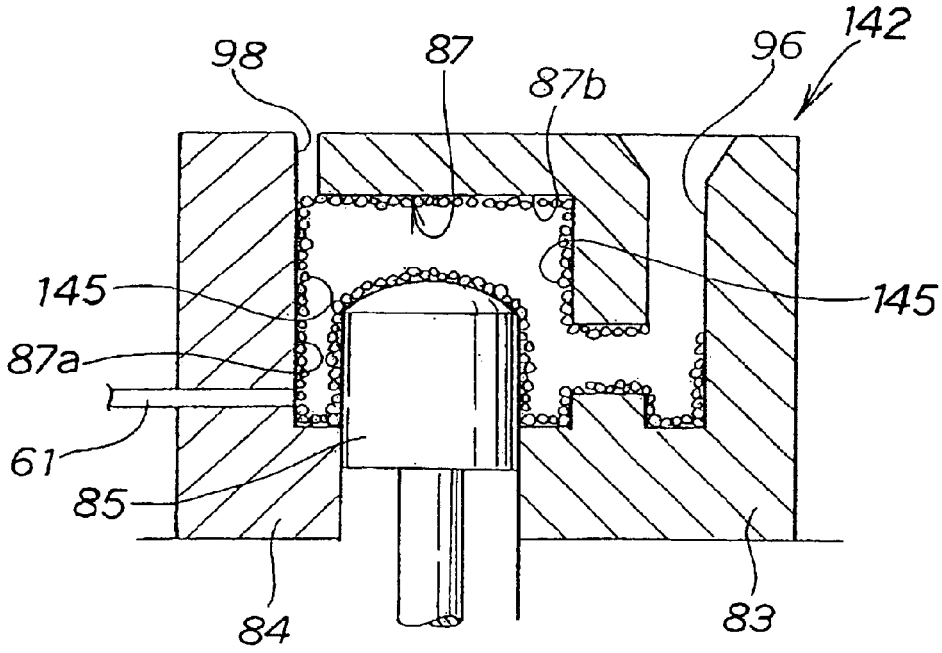
Figure 21B:
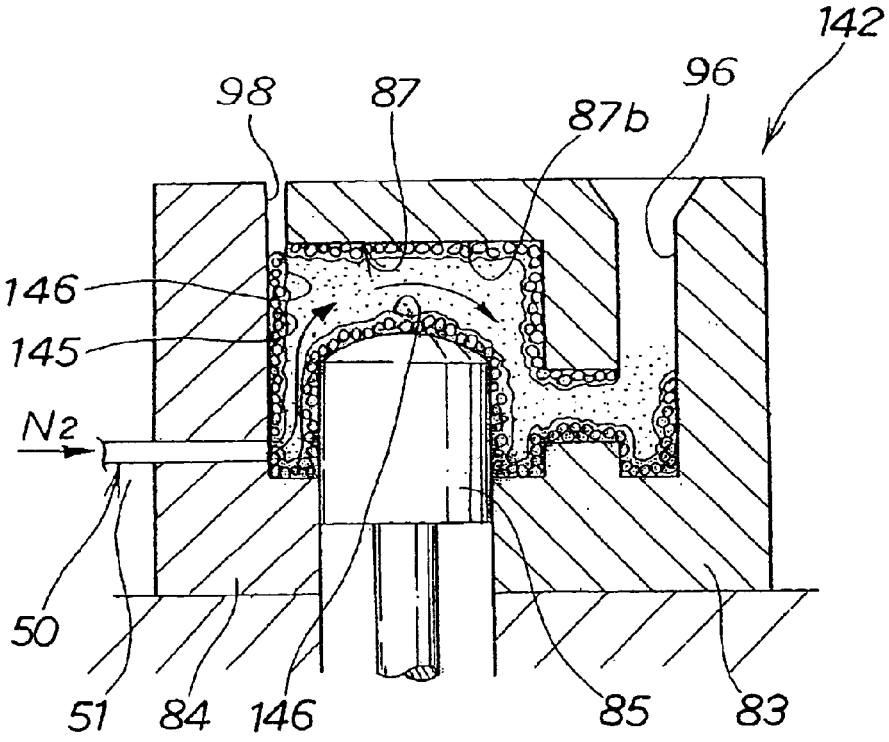
Figure 22A:
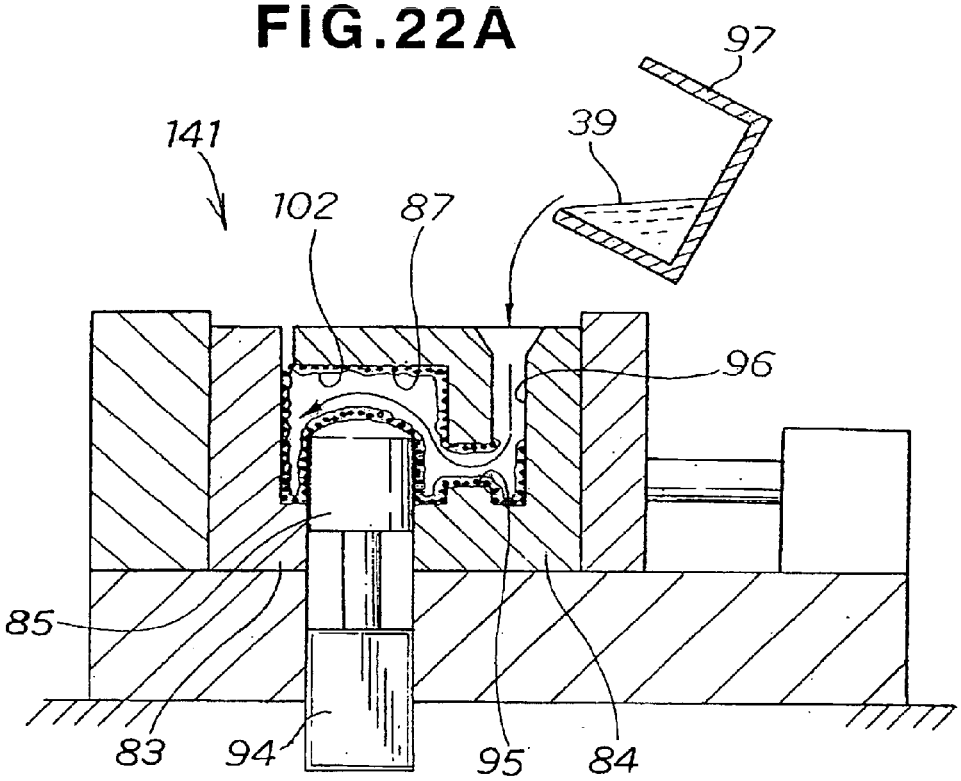
Figure 22B:
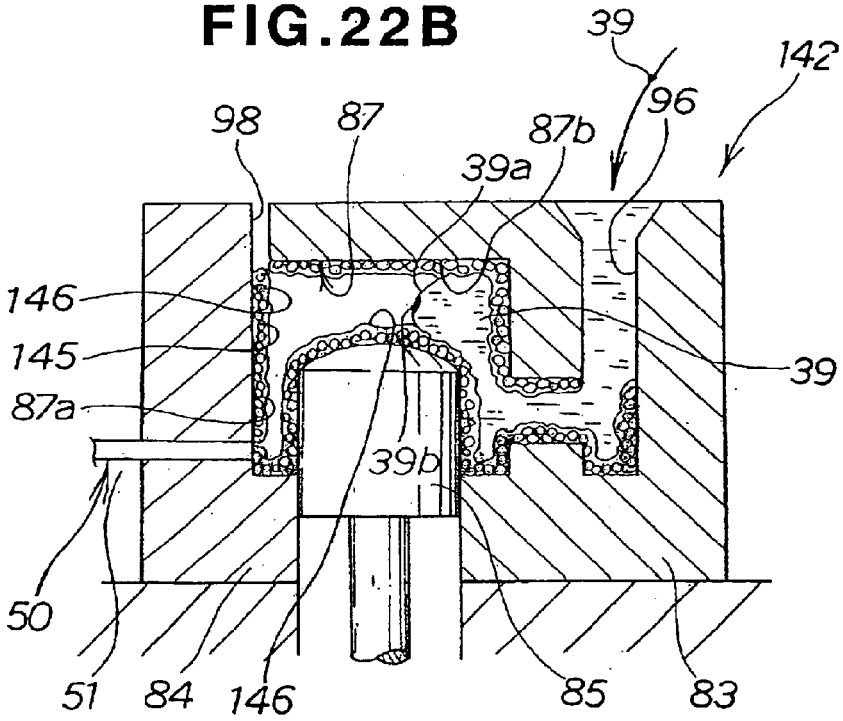
Figure 23A:
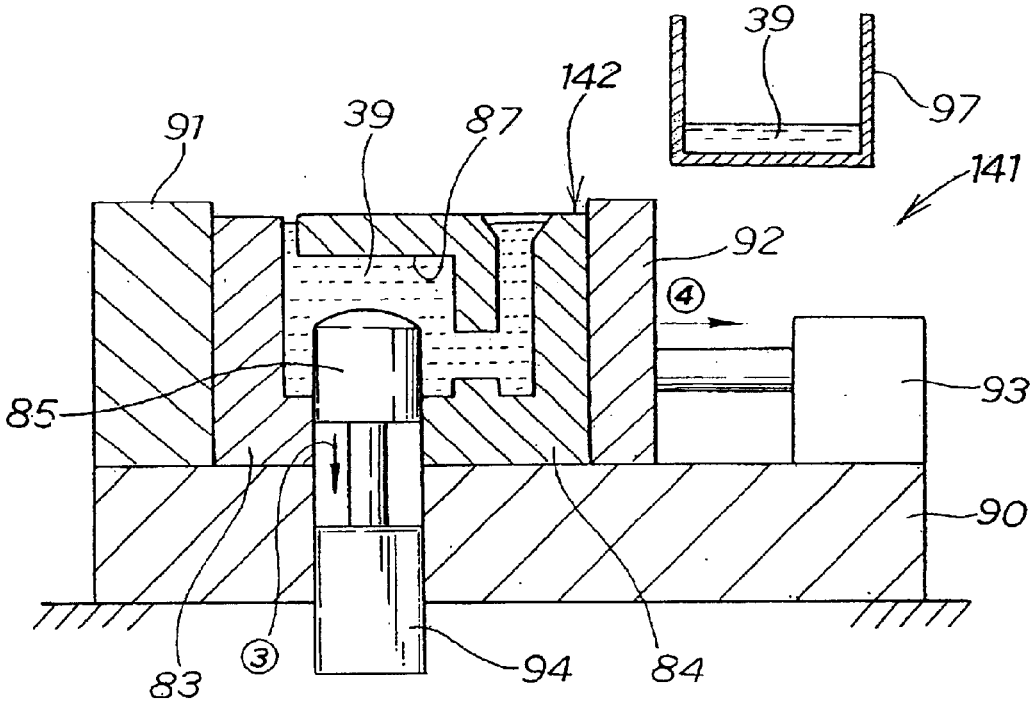
Figure 23B:
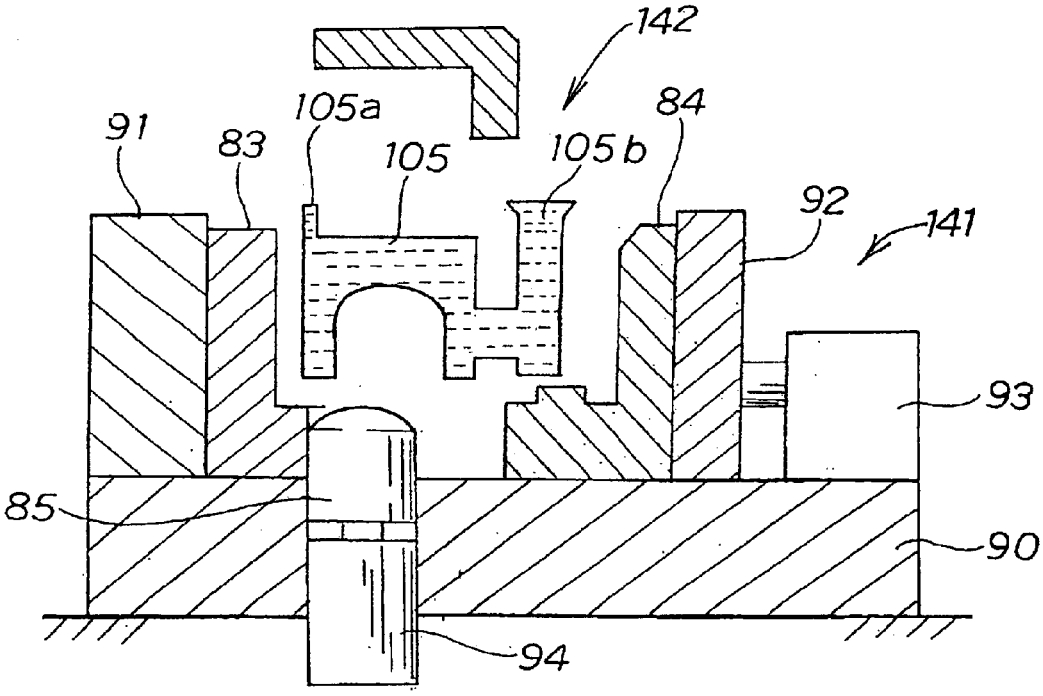
Figure 24:
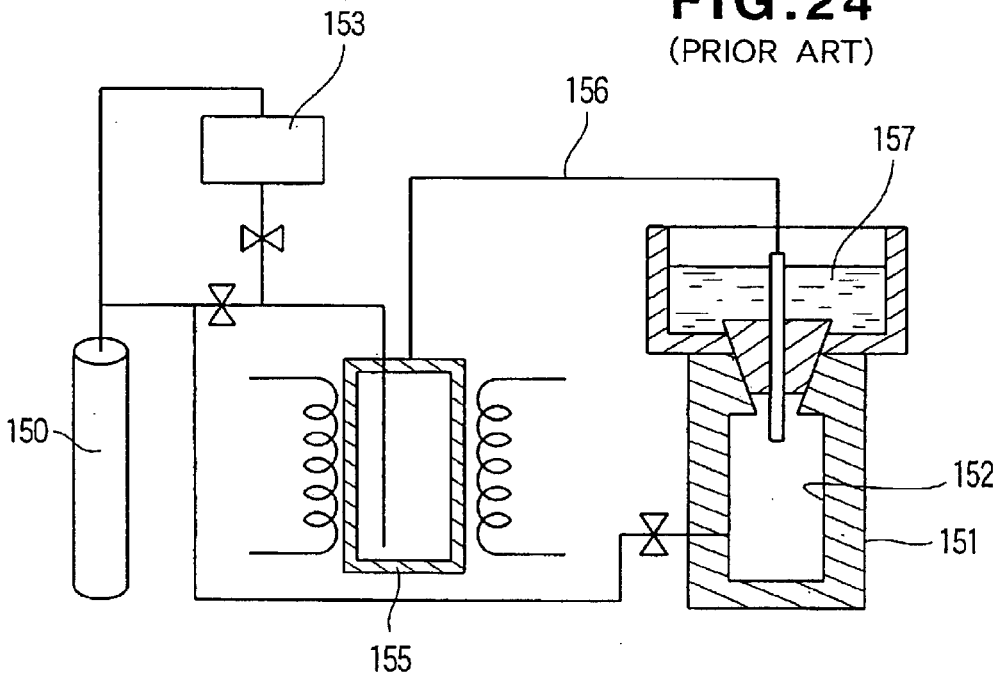
FIG.24 (PRIOR ART)
Figure 25:
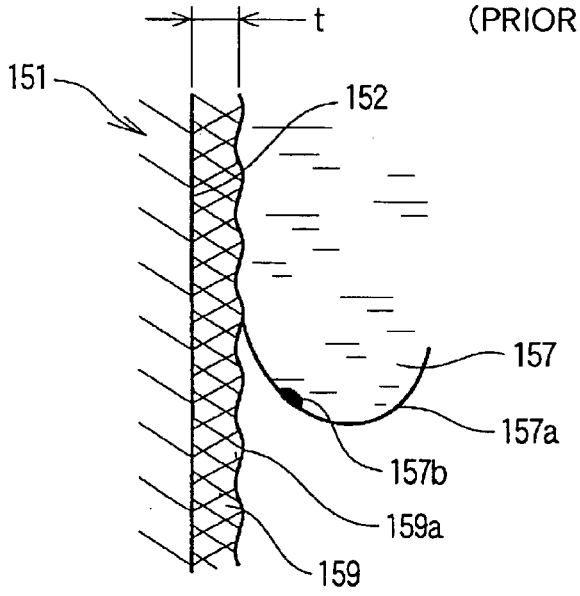
FIG.25 (PRIOR ART)

FIG. 20 is a schematic diagram of an aluminum casting apparatus for implementing an aluminum casting method according to a fourth embodiment of the present invention, illustrating an example of providing a heater at a midpoint of the nitrogen gas injection path in the second embodiment;

FIGS. 21A and 21B illustrate the formation of a cavity with a mold surface after the application of a mold release agent to the mold surface and the formation of magnesium nitride by the reaction between a heated nitrogen gas and magnesium in the surface of a mold release layer, in the aluminum casting method of the fourth embodiment;

FIGS. 22A and 22B illustrate the supply of molten aluminum into the cavity and the contact of the surface of the molten aluminum with the magnesium nitride;

FIGS. 23A and 23B illustrate the supply of a predetermined amount of the molten aluminum to the cavity and the opening of the cast to obtain an aluminum cast solidified;

FIG. 24 is a schematic diagram of a casting apparatus for implementing a conventional aluminum casting method; and FIG. 25 illustrates the contact of the surface of molten aluminum with the surface of a magnesium-nitrogen compound layer deposited on the mold surface forming a cavity, in the conventional aluminum casting method.

BEST MODE FOR CARRYING OUT THE INVENTION

Figure 1:
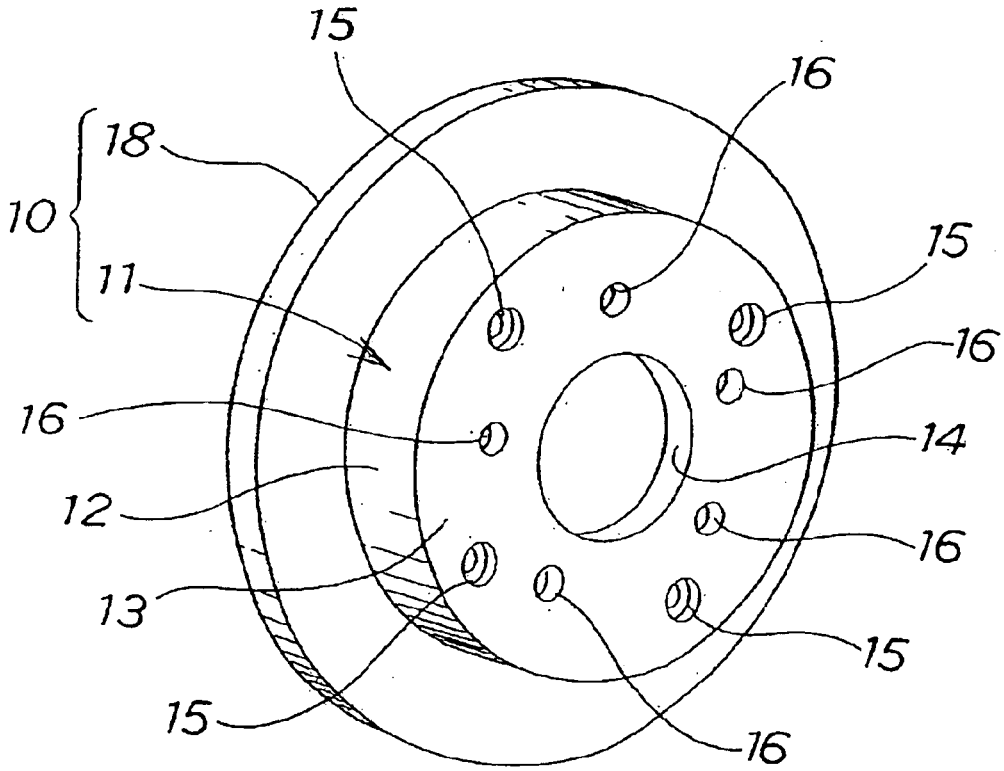
FIG. 1 is a perspective view of a brake disc cast by an aluminum casting method according to first and third embodiments of the present invention.

FIG. 1 illustrates a brake disc 10 for use in, e.g., vehicles, cast by an aluminum casting method of the present invention. The brake disc 10 is a member made of aluminum, including a cylindrical hub 11 and a disc 18 integrally formed with the hub 11.

The hub 11 has a lid 13 at the outer end of a peripheral wall 12. The lid 13 has an opening 14 formed in its center and a plurality of bolt holes 15 and a plurality of stud holes 16 formed around the opening 14. Bolts not shown are inserted through the bolt holes 15 to mount the brake disc 10 to a drive shaft (not shown) with the bolts. The stud holes 16 are holes into which studs not shown are press fitted, to mount a wheel to the brake disc 10.

Figure 2:
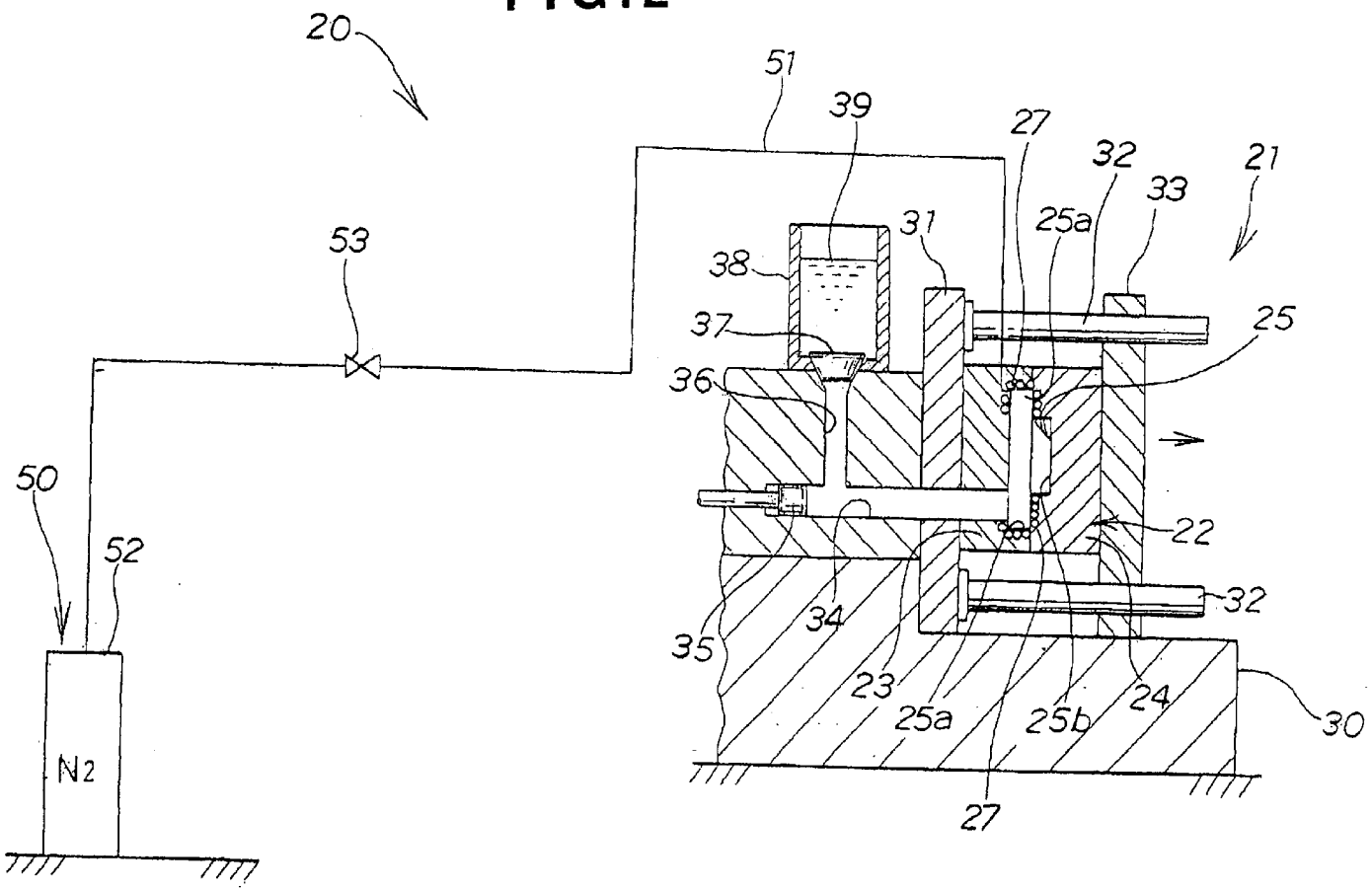
FIG. 2 is a schematic diagram of an aluminum casting apparatus for implementing the aluminum casting method according to the first embodiment of the present invention.

FIGS. 2 to 8 illustrate a first embodiment of the present invention. FIG. 2 is a schematic diagram of an aluminum casting apparatus for the implementation of a casting method of the first embodiment.

An aluminum casting apparatus 20 includes a casting apparatus body 21 having a mold 22 and a nitrogen gas injector 50 for injecting a nitrogen ($N_2$) gas into a cavity formed by a mold surface 25 of the mold 22. The mold 22 consists of a fixed mold 23 and a movable mold 24. The mold surface 25 is a surface formed within the fixed mold 23 and the movable mold 24.

The casting apparatus body 21 has a base 30 to which a fixed plate 31 is mounted. The fixed mold 23 is attached to the fixed plate 31. Guide rods 32, 32 are mounted to the fixed plate 31. The guide rods 32, 32 movably support a movable plate 33. The movable plate 33 is attached to the movable mold 24. A runner 34 opening into the cavity is formed through the fixed mold 23 and the base 30. A plunger 35 is movable within the runner 34. A pouring gate 36 is formed perpendicular to the runner 34. The upper end of the pouring gate 36 is closed by a tenon 37. A pouring tank 38 is provided above the pouring gate 36 and communicates with the poring gate 36.

In this aluminum casting apparatus 20, the movable plate 33 is shifted by a shifting means (not shown) in the direction of an arrow so that the movable mold 24 is shifted between a mold clamped position (the position shown in the figure) and a mold open position. Fixing the movable mold 24 in the mold clamped position provides the cavity formed by the mold surface 25 of each of the fixed mold 23 and the movable mold 24.

Molten aluminum 39 is supplied to the cavity and then the plunger 35 pressurizes the molten aluminum 39 so as to form an aluminum casting inside the cavity.

The casting apparatus body 21 further includes a heater (cartridge heater) 27 embedded in the mold 22, positioned along an area 25*a* of the mold surface 25 forming the cavity, and corresponding to the disc 18 (thin-section part) shown in FIG. 1, that is, along the outer periphery of the fixed mold 23 and the outer periphery of the movable mold 24. This allows the area 25*a* corresponding to the disc 18 (thin-section part) to be heated to a predetermined temperature (from 400° C. to less than 500° C., for example).

The area 25*a* corresponding to the disc 18 (thin-section part) is an area of the mold surface 25 in which it is relatively difficult to maintain good runnability.

The nitrogen gas injector 50 communicates with the cavity via the nitrogen gas injection path 51. The nitrogen gas injection path 51 has a nitrogen gas switching valve 53 at its midpoint. The nitrogen gas switching valve 53 is a valve for switching the nitrogen gas injection path 51 between a open and a closed state. Switching the nitrogen gas switching valve 53 to the open state allows the injection of a nitrogen gas in the nitrogen gas cylinder 52 into the cavity through the nitrogen gas injection path 51.

Now a casting method of the first embodiment using the aluminum casting apparatus 20 shown in FIG. 2 will be described with reference to FIG. 3.

Step (hereinafter abbreviated as "ST") 10: With a mold opened, a mold release agent including magnesium is applied to a mold surface to form a cavity.

ST11: The mold is clamped to form the cavity by the mold surface to which the mold release agent is applied.

ST12: An area of the mold surface corresponding to a thin-section part of a cast is heated.

ST13: A nitrogen gas is injected into the cavity. The nitrogen gas is reacted with the magnesium, forming magnesium nitride on the mold surface.

ST14: Molten aluminum is supplied to the cavity in which the magnesium nitride is formed, with the surface of the molten aluminum being reduced by the magnesium nitride so as to form a cast of aluminum in the cavity.

Now steps ST10 to ST14 of the above aluminum casting method will be described with reference to FIGS. 4 to 8B.

Figure 4:
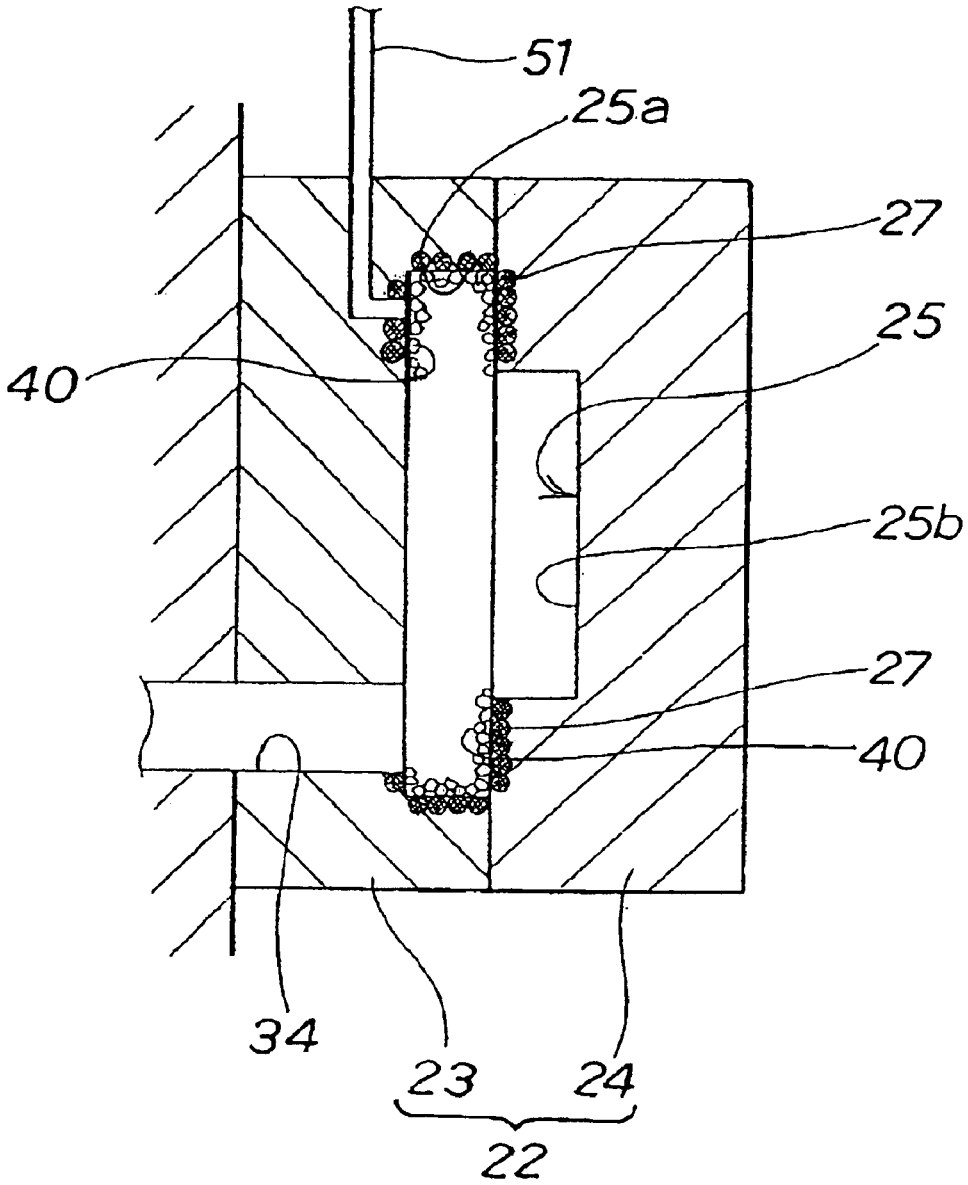
FIG. 4 illustrates a mold for a detailed explanation of ST11 and ST12 shown in FIG. 3.

First, at ST10, the movable mold 24 of the mold 22 shown in FIG. 2 is shifted as shown by the arrow to open the mold 22. Then, as shown in FIG. 4, a mold release agent is applied to the area 25*a* of the mold surface of the fixed and movable molds 23 and 24, corresponding to a thin-section part of a cast (an area corresponding to the disk 18 of the brake disc 10 shown in FIG. 1) to form a mold release layer 40.

With the mold 22 opened, the mold release agent is applied to the area 25*a* of the mold surface 25, corresponding to the thin-section part of the cast to form the mold release layer 40. After the formation of the mold release layer 40, the mold 22 is clamped as shown in FIG. 4 to form the cavity with the mold surface 25.

The mold release agent applied to the area 25*a* of the mold surface is an oil-based mold release agent including 2 wt % to 20 wt % of powder magnesium. The magnesium content is preferably 5 wt % to 10 wt %. The reason why the magnesium content is 0.2 wt % to 20 wt %, and preferably is 5 wt % to 10 wt %, will be described below.

After the formation of the mold release layer 40 in the area 25*a* of the mold surface, the heater (cartridge heater) 27 is heated. During the heating, the heater (cartridge heater) 27 is controlled so that the temperature of the area 25*a* of the mold surface is from 400° C. to less than 500° C., for example.

Figure 3:
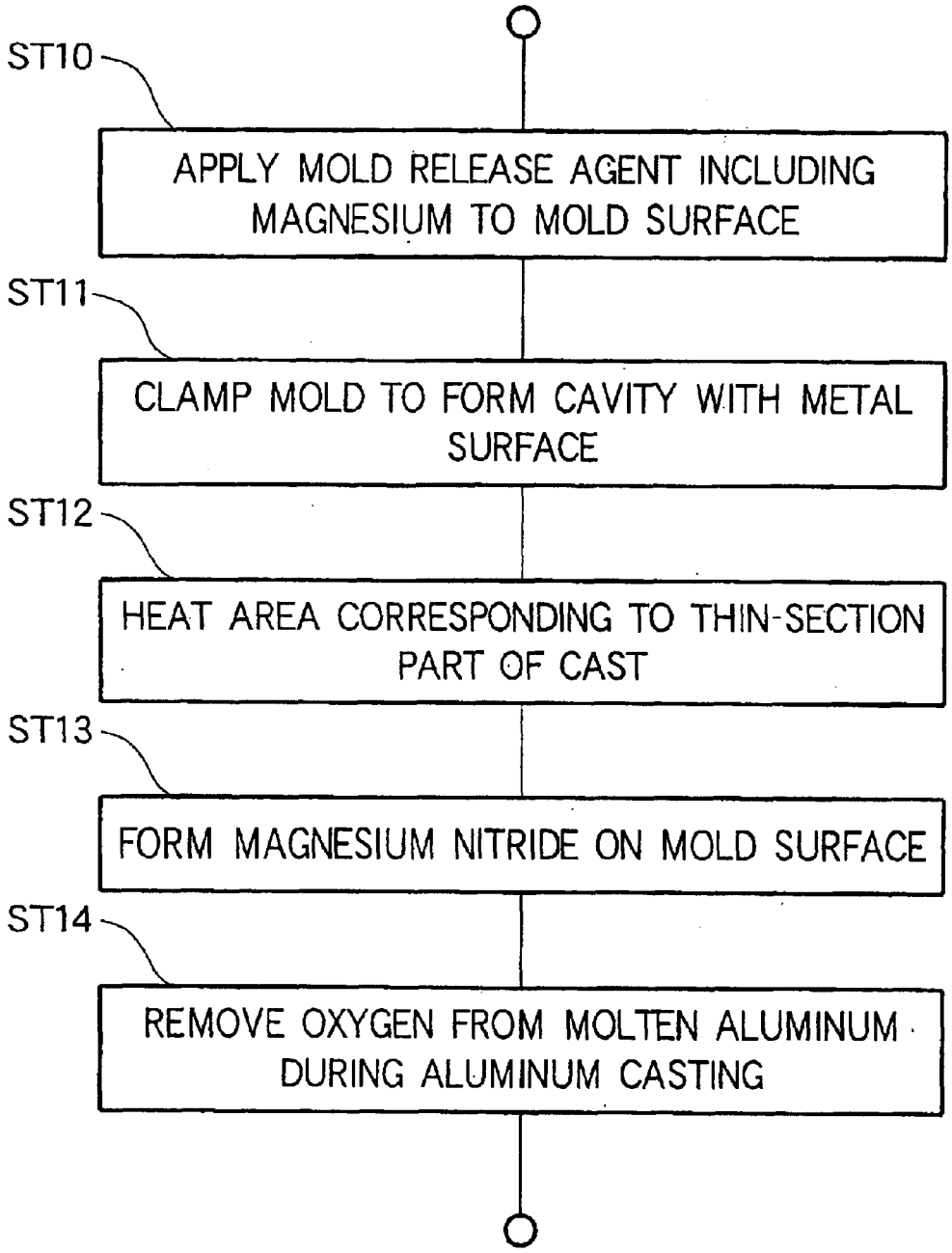
FIG. 3 is a flowchart illustrating the aluminum casting method according to the first embodiment.
Figure 5:
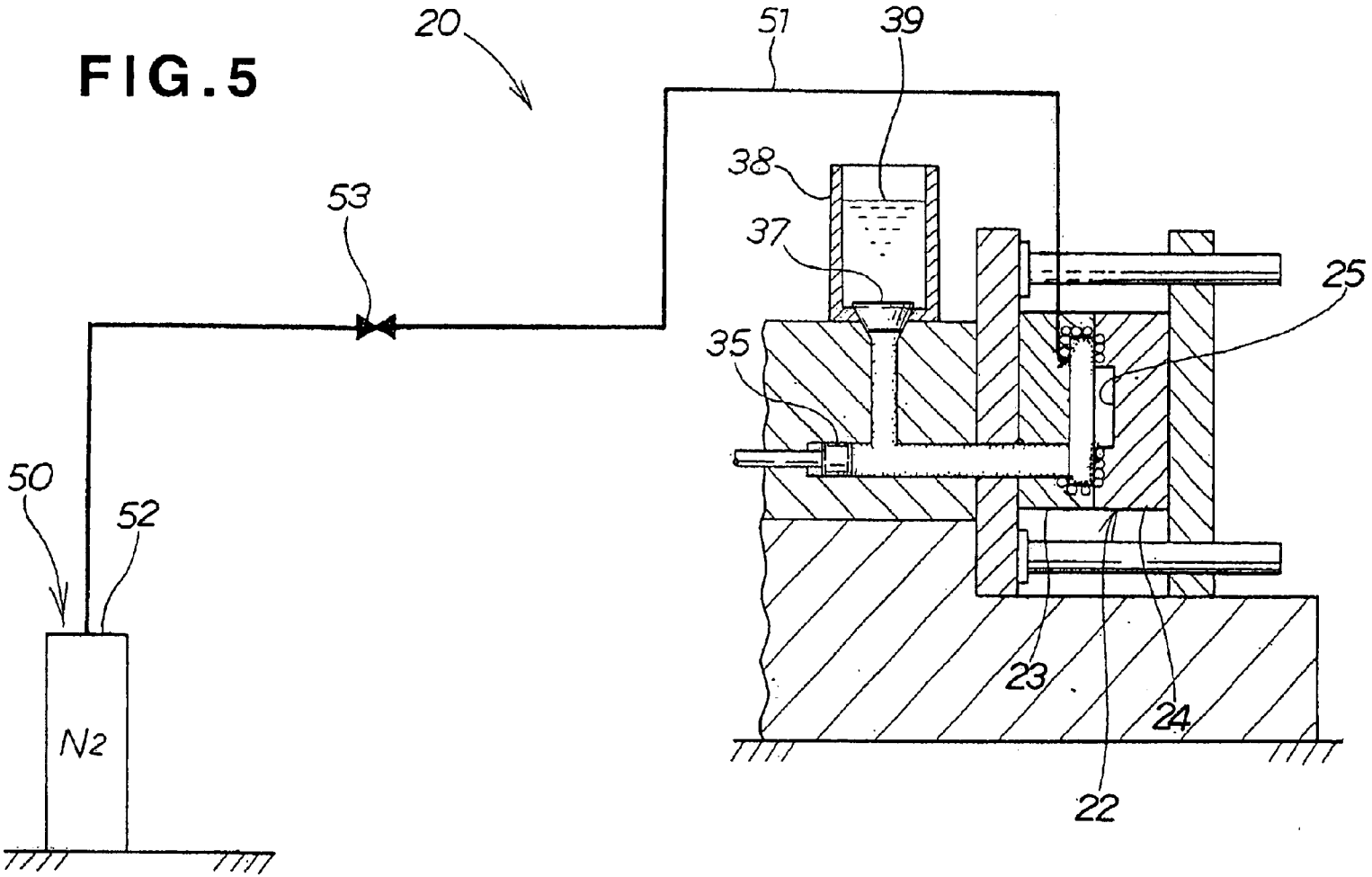
FIG. 5 is a schematic diagram of the aluminum casting apparatus for the detailed explanation of ST13 shown in FIG. 3, illustrating the injection of a nitrogen gas into a cavity.
Figure 6:
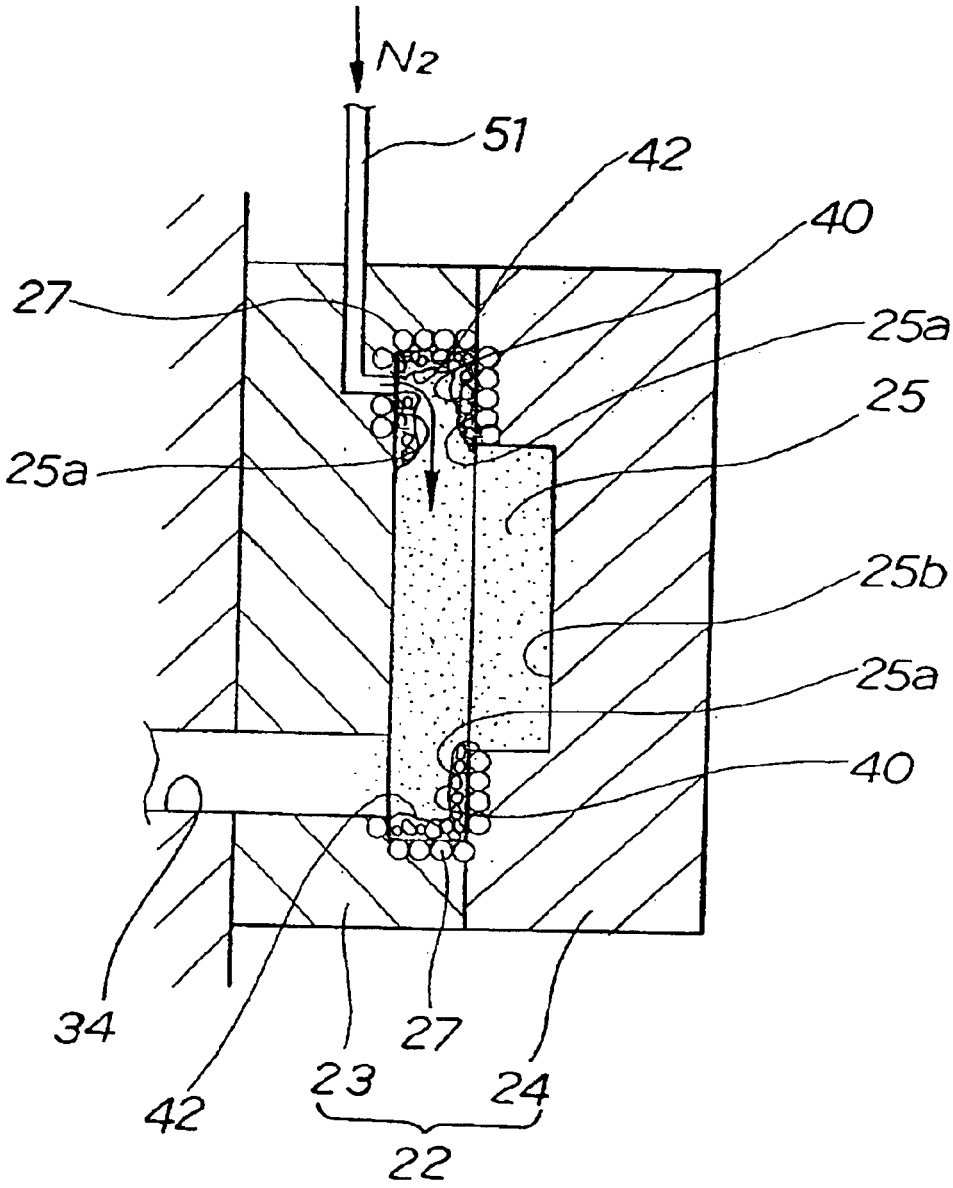
FIG. 6 illustrates the mold for the detailed explanation of ST13 shown in FIG. 3, illustrating the formation of magnesium nitride on part of the mold surface.

An example of ST13 shown in FIG. 3 is illustrated in FIGS. 5 and 6.

In FIG. 5, the nitrogen switching valve 53 of the nitrogen gas injector 50 is switched to the open state. Switching the nitrogen switching valve 53 to the open state provides the flow of a nitrogen gas in the nitrogen gas cylinder 52 into the nitrogen injection path 51. The nitrogen gas in the nitrogen gas cylinder 52 is thus injected into the cavity formed by the mold surface 25 via the nitrogen injection path 51.

As described above, the area 25*a* of the mold surface 25 is heated by the heater (cartridge heater) 27 to 400° C. to less than 500° C., for example. This causes the reaction between the magnesium in the surface of the mold release layer 40 and the nitrogen gas as shown in FIG. 6, forming magnesium nitride ($Mg_3N_2$) 42 on the surface of the area 25*a*.

Here the reason why the content of magnesium included in the mold release agent is set at 2 wt % to 20 wt % is described. The magnesium content of less than 2 wt % leads to poor reaction with the nitrogen gas. For good reaction, it is required to heat the area 25*a* of the mold surface 25 to 500° C. or more, resulting in longer heating time. This increases the cycle time of the casting process, reducing the productivity. For this reason, the magnesium content is set at 2 wt % or more to reduce the heating temperature of the area 25*a* of the mold surface, reducing the cycle time of the casting process, and thereby increasing the productivity. Setting the magnesium content at 5 wt % or more further increases the above effects.

The magnesium content exceeding 20 wt % may cause the generation of excessive reaction heat during the formation of magnesium nitride by the reaction of the nitrogen gas with the magnesium. The atmosphere may become 700° C. or more, reducing the durability of the mold. The magnesium content is therefore set at less than 20 wt % so as to reduce the reaction heat and increase the durability of the mold. Setting the magnesium content at less than 10 wt % further increases the above effects.

Thus setting the content of magnesium included in the mold release agent at 2 wt % to 20 wt % and heating the area 25*a* of the mold surface 25 by the heater (cartridge heater) 27 to, e.g., 400° C. to less than 500° C. to heat the mold release layer 40 facilitate the formation of the magnesium nitride 42. This results in efficient formation of the magnesium nitride 42.

Setting the heating temperature at 400° C. to less than 500° C. allows the reduction in temperature of the atmosphere to less than 700° C. and the maintenance of the durability of the mold 22. After the formation of the magnesium nitride 42 in the area 25*a* of the mold surface 25, the nitrogen switching valve 53 shown in FIG. 5 is switched to the closed state.

As described with FIGS. 4 and 6, during the formation of the magnesium nitride 42, the mold release agent including magnesium is first applied to the area 25*a* of the mold surface 25 to form the mold release layer 40. Then, a nitrogen gas is injected into the cavity formed with the mold surface 25. Magnesium in the surface of the mold release layer 40 reacts with the nitrogen gas, forming the magnesium nitride 42 in the area 25*a* of the mold surface 25. Thus, the nitrogen gas reacts only with the magnesium exposed in the surface of the mold release layer 40, of all the magnesium included in the mold release layer 40. This allows reduction in forming time of the magnesium nitride 42. In addition, the reaction of the nitrogen gas only with the magnesium exposed in the surface of the mold release layer 40 enables forming the magnesium nitride 42, reducing the amount of the nitrogen gas used.

As a method of attaching magnesium to the area 25*a* of the mold surface 25, another method of heating and sublimating magnesium and injecting the sublimated gaseous magnesium into the cavity to deposit the gaseous magnesium in the area 25*a* of the mold surface 25 may be conceived.

To adopt this method, however, it is required to provide a heating means for sublimating the magnesium and also a gas injecting means for injecting the sublimated gaseous magnesium into the cavity using an inert gas, for example. This increases the cost of equipment, preventing reduction in cast cost.

In this context, the mold release agent including magnesium is applied to the area 25*a* of the mold surface 25. This eliminates the need for a heating means for sublimating magnesium and a gas injecting means for injecting gaseous magnesium into the cavity. The application of a mold release agent to the mold surface 25 so as to release a casting from the mold 22 at the completion of the casting process is a general operation step. This application step can be utilized to apply magnesium to the area 25*a* of the mold surface 25, eliminating the need for adding a new step of applying magnesium to the area 25*a* of the mold surface 25. This allows the simplification of the casting process.

FIGS. 7A to 8B illustrate ST14 shown in FIG. 3.

Figure 7A:
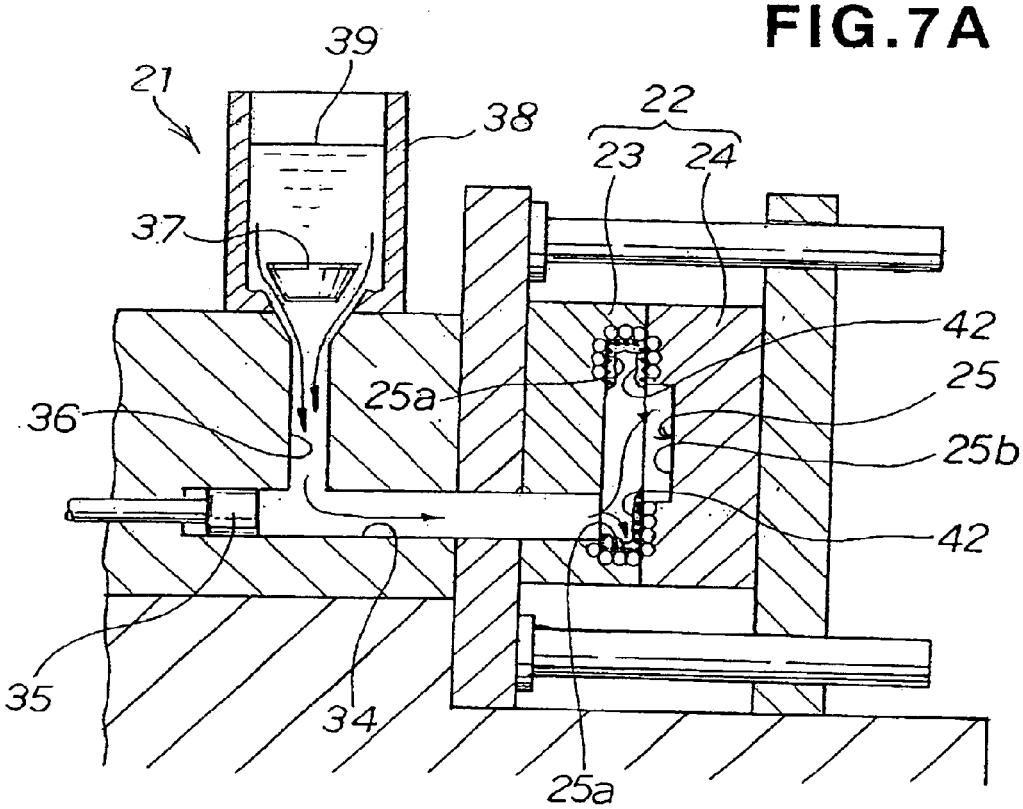
FIGS. 7A and 7B illustrate the mold for the detailed explanation of ST14 shown in FIG. 3, illustrating the injection of molten magnesium into the cavity and the contact between the molten aluminum and the magnesium nitride; charged into the cavity, so as to obtain an aluminum casting.

In FIG. 7A, the tenon 37 of the casting apparatus body 21 is controlled to open the pouring gate 36. The molten aluminum 39 in the pouring tank 38 is supplied via the pouring gate 36 and the runner 34 into the cavity formed with the mold surface 25 as shown by arrows.

Although the use of a water-based mold release agent as the mold release agent may be conceived, the use of a water-based mold release agent causes magnesium included in the mold release agent to react with water (oxygen) in the mold release agent, forming magnesium oxide. This prevents the subsequent injection of a nitrogen gas into the cavity from forming magnesium nitride and reducing the surface of the molten aluminum 39.

Thus the mold release agent is an oil-based mold release agent. The use of an oil-based mold release agent prevents the reaction between magnesium and water (oxygen). This allows the formation of magnesium nitride by the injection of a nitrogen gas into the cavity and the reduction of the surface of the molten aluminum 39 with the magnesium nitride to maintain the molten aluminum 39 in good fluidity.

Since the molten aluminum 39 is a kind of viscous fluid, a path with a large section area allows the easy maintenance of good runnability, and a path with a small section area or a path with cross section of a small vertical or lateral dimension worsens the runnability. The cavity inevitably has an area causing poor runnability.

An area of the mold surface 25 forming a large space (an area allowing good runnability) 25*b* allows the smooth flow of the molten aluminum 39 even if an oxide 39*b* (See FIG. 7B) is formed on the surface 39*a* of the molten aluminum 39.

The area of the mold surface 25 forming a small space (that is, an area in which the maintenance of good runnability is difficult) 25*a* causes relatively poor flow of the molten aluminum 39, so that the formation of the oxide 39*b* on the aluminum surface 39*a* makes it difficult to smoothly flow the molten aluminum 39.

To deal with this, the magnesium nitride 42 is formed in the area 25*a* of the mold surface 25 forming a small space to reduce the oxide 39*b* of the molten aluminum 39 using the magnesium nitride 42. The function is described with FIG. 7B.

Figure 7B:
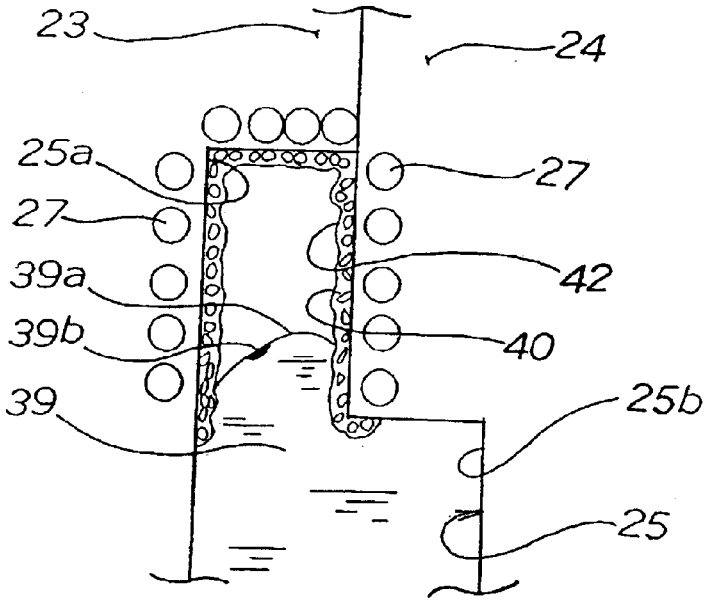

In FIG. 7B, when the molten aluminum 39 supplied to the cavity reaches the area 25*a* of the mold surface 25, the surface 39*a* of the molten aluminum 39 is brought into contact with the magnesium nitride 42. On the surface 39*a* of the molten aluminum 39, the oxide 39*b* may be formed. If the oxide 39*b* is formed, the reaction between the oxide 39*b* and the magnesium nitride 42 allows the removal of oxygen from the oxide 39*b*. This prevents the formation of an oxide film on the surface 39*a* of the molten aluminum 39, avoiding an increase in the surface tension of the molten aluminum 39. The area 25*a* of the mold surface 25 thus allows the maintenance of the molten aluminum 39 in good runnability.

Figure 8A:
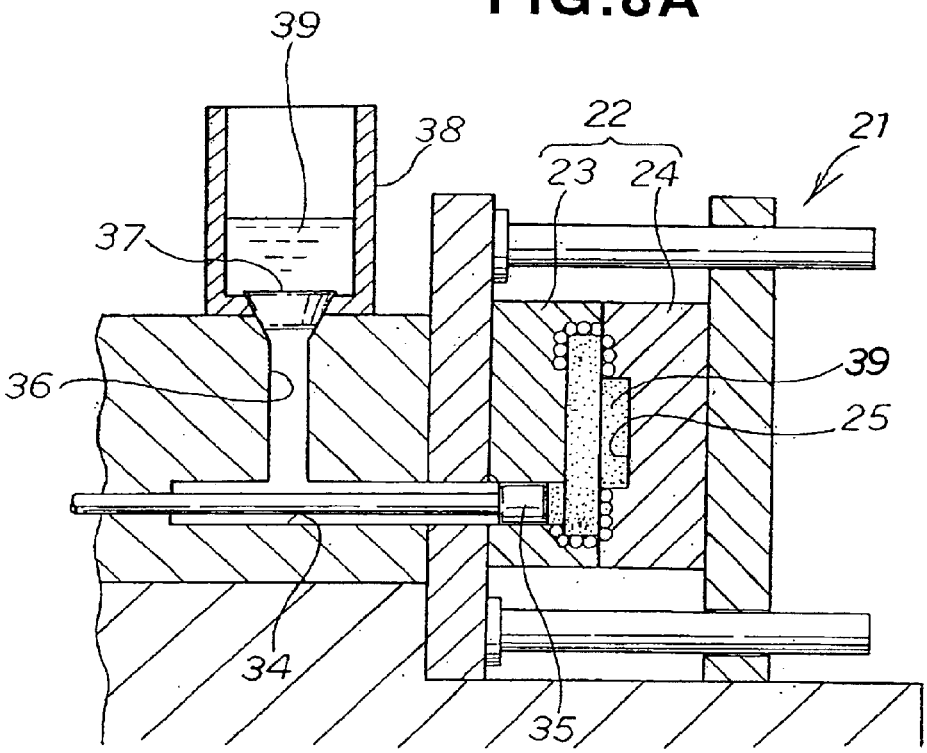
FIGS. 8A and 8B illustrate the opening of the mold after the molten aluminum is charged into the cavity, so as to obtain an aluminum casting.

In FIG. 8A, after a predetermined amount of the molten aluminum 39 is supplied from the pouring tank 38 to the cavity, the pouring gate 36 is closed with the tenon 37. In this state, the plunger 35 is pushed toward the cavity to charge the molten aluminum 39 into the cavity.

Figure 8B:
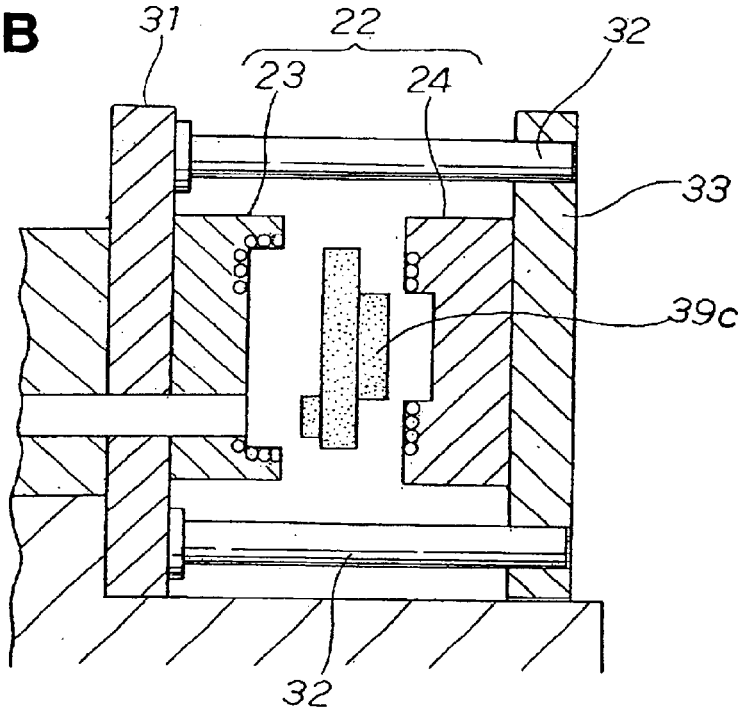

In FIG. 8B, the mold 22 is opened to take out an aluminum cast 39*c* resulting from the solidification of the molten aluminum 39 (See FIG. 88). The maintainability of good runnability during pouring allows improvement in quality of the aluminum casting 39*c*. The aluminum casting 39*c* is processed to provide the brake disc 10 shown in FIG. 1.

Now second to fourth embodiments will be described. In the second to fourth embodiments, like components as in the first embodiment are denoted by like reference numerals and will not be described.

First, a casting method of the second embodiment will be described with reference to FIGS. 9 to 12.

Figure 9:
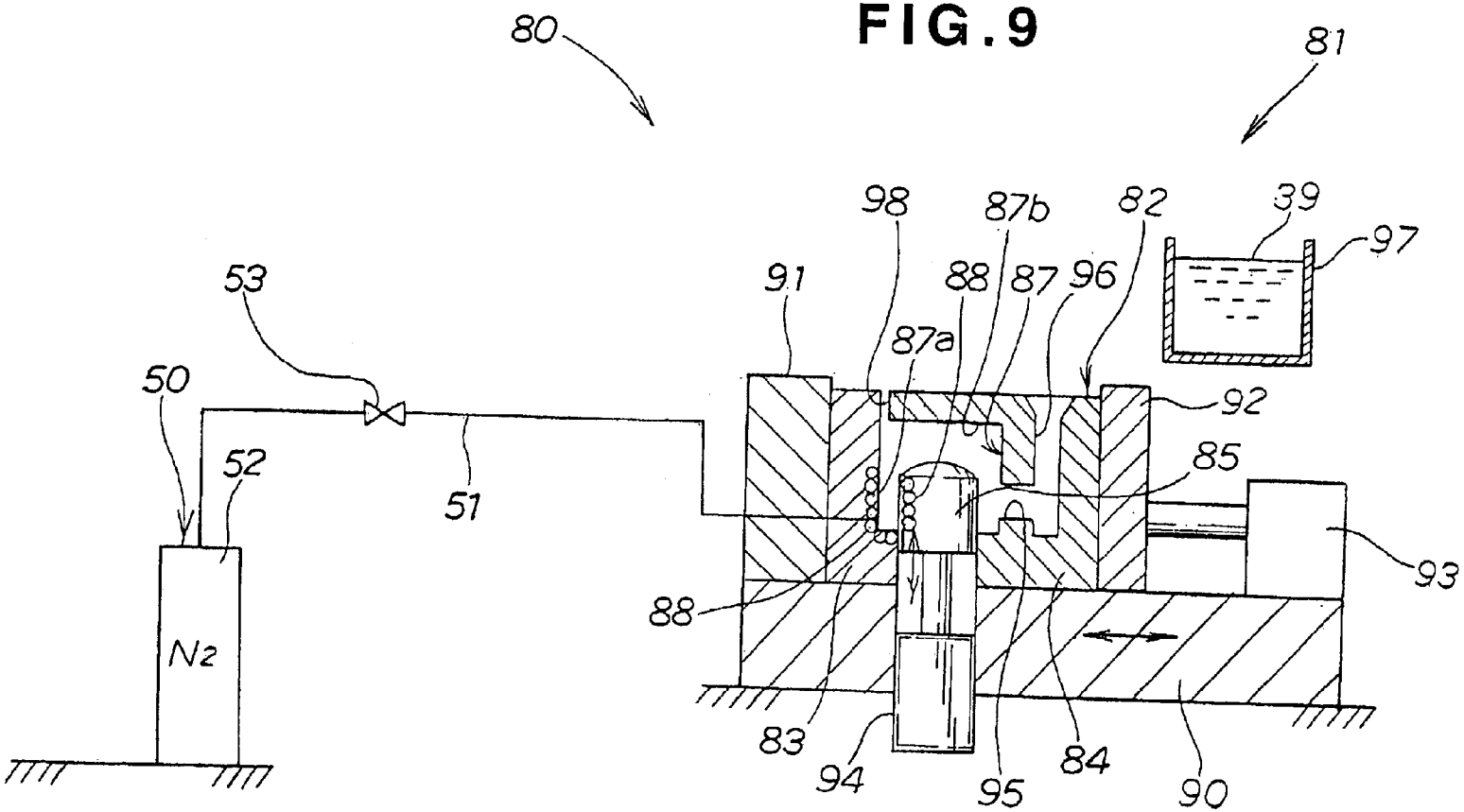
FIG. 9 is a schematic diagram of an aluminum casting apparatus for implementing an aluminum casting method according to a second embodiment of the present invention.

FIG. 9 illustrates the outline of an aluminum casting apparatus for the implementation of the aluminum casting method according to the second embodiment.

An aluminum casting apparatus 80 includes a casting apparatus body 81 having a mold 22 and a nitrogen gas injector 50 for injecting a nitrogen ($N_2$) gas into a cavity formed by a mold surface 87 of the mold 82. The mold 82 consists of a fixed mold 83, a movable mold 84, and a core 85. The mold surface 87 is a surface formed by the fixed mold 83, movable mold 84 and core 85.

The casting apparatus body 81 has a base 90 to which a fixed plate 91 is mounted. The fixed mold 83 is attached to the fixed plate 91. A movable plate 92 is movably mounted to the base 90. The movable plate 92 is shifted by a shift member 93 mounted to the base 90. The core 85 of the mold 82 is mounted to base 90 with an elevation member 94 in a vertically movable manner. A runner 95 opening into the cavity is formed in the movable mold 84. A pouring gate 96 is formed perpendicular to the runner 95. A pouring tank 97 storing molten aluminum 39 is provided above the pouring gate 96. An opening 98 as a gas vent or a riser is formed in an upper end of the mold 82.

In FIG. 9, the pouring gate 96 and the opening 98 are illustrated greater relative to the cavity for easy understanding of the casting apparatus body 81. The pouring gate 96 and the opening 98 are actually sufficiently small relative to the cavity. When the mold 82 is clamped, the cavity can be maintained in a substantially hermetically-sealed state.

According to this aluminum casting apparatus 80, the movable plate 92 is shifted by the shift member 93 in the direction of arrows so that the movable mold 84 is shifted between a mold clamped position (the position shown in the figure) and a mold open position. The elevation member 94 shifts the core 85 in the direction of arrows, allowing the core 85 to be shifted between a mold clamped position (the position shown in the figure) and a mold open position.

Fixing the movable mold 84 and the core 85 in the mold clamped positions provides the cavity formed by the mold surface 87 of the fixed mold 83, movable mold 84 and core 85. The molten aluminum 39 is supplied to the cavity to make an aluminum casting inside the cavity.

The casting apparatus body 81 of the second embodiment utilizes empty weight under ambient pressure to pour the molten aluminum 39 into the cavity, being different in this regard from the casting apparatus body 21 of the first embodiment.

A heater (cartridge heater) 88 is embedded in the mold 82, positioned along an area 87*a* of the mold surface 87 forming the cavity, being corresponding to a cylinder (a thin-wall part) of a cylinder block, that is, along a lower left portion of the fixed mold 83 and the outer periphery of core 85. This allows the area 87*a* of the mold surface 87 to be heated to a predetermined temperature (from 400° C. to less than 500° C., for example).

The area 87*a* of the mold surface 87 is an area of the mold surface 87 in which it is relatively difficult to maintain good runnability.

Now an example of implementing a casting method of the second embodiment using the aluminum casting apparatus 80 will be described with reference to FIG. 3 and FIGS. 9 to 12B.

First, step ST10 of the flowchart shown in FIG. 3 will be described.

The movable mold 84 of the mold 82 shown in FIG. 9 is shifted to open the mold 82. Then, a mold release agent is applied to the area 87*a* of the mold surface 87 of the fixed and movable molds 83, 84 and the core 85.

Figure 10A:
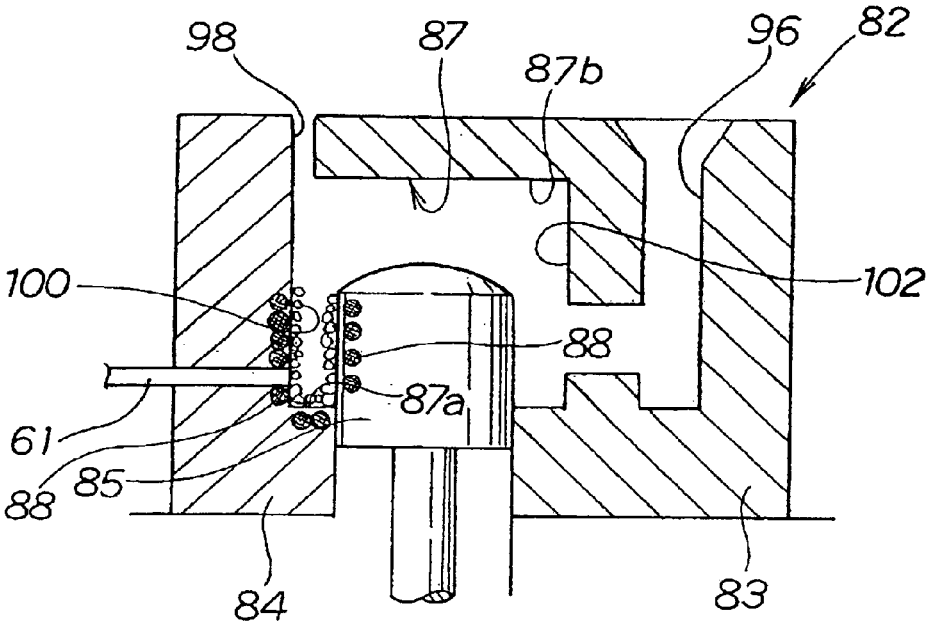
FIGS. 10A and 10B illustrate a mold formed with a cavity after the application of a mold release agent to part of a mold surface and the injection of a nitrogen gas into the cavity by the aluminum casting method according to the second embodiment.
Figure 10B:
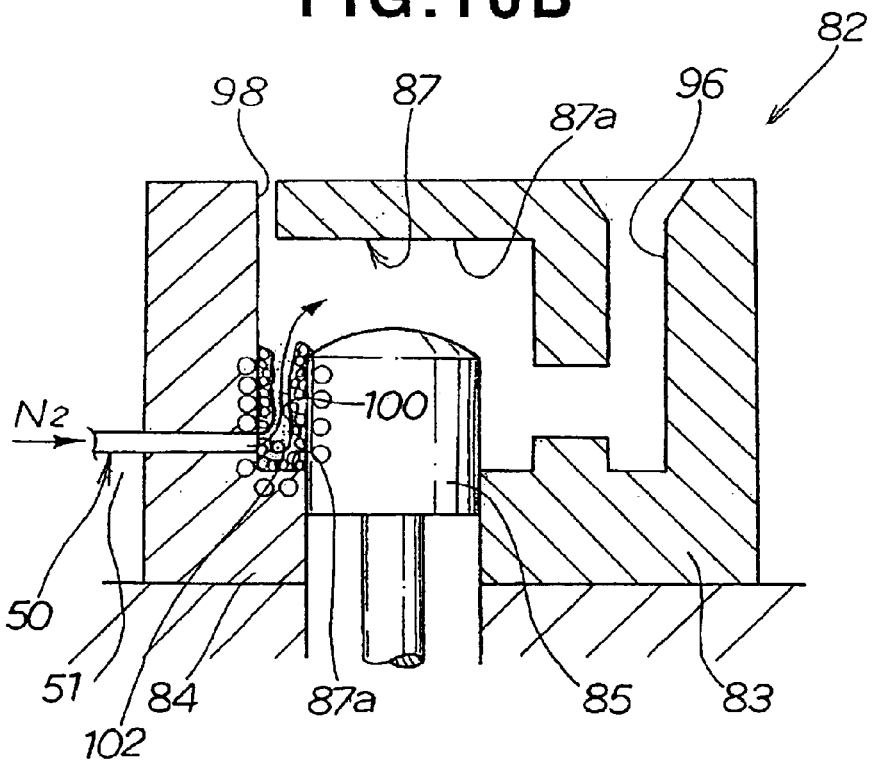

FIGS. 10A and 10B illustrate an example of ST11 to ST13 of the casting method shown in FIG. 3.

In FIG. 10A, the mold release agent is applied to the area 87*a* of the mold surface 87 to form a mold release layer 100 in the area 87*a*. Then the mold 82 is clamped to form the cavity with the mold surface 87. The mold release agent applied to the area 87*a* of the mold surface 87 is an oil-based mold release agent including 2 wt % to 20 wt % of powder magnesium. The magnesium content is preferably 5 wt % to 10 wt %. The reason why the magnesium content is 2 wt % to 20 wt %, and preferably is 5 wt % to 10 wt %, is the same as in the first embodiment and will not be described.

After the formation of the mold release layer 100 in the area 87*a* of the mold surface 87, the heater (cartridge heater) 88 is heated. During the heating, the heater (cartridge heater) 88 is controlled so that the temperature of the area 87*a* of the mold surface 87 is from 400° C. to less than 500° C., for example.

In FIG. 10B, a nitrogen switching valve 53 of the nitrogen gas injector 50 shown in FIG. 9 is switched to the open state. Switching the nitrogen switching valve 53 to the open state provides the flow of a nitrogen gas in a nitrogen gas cylinder 52 into a nitrogen gas injection path 51. The nitrogen gas in the nitrogen gas cylinder 52 is thus injected into the cavity formed by the mold surface 87 via the nitrogen injection path 51.

Here the area 87*a* of the mold surface 87 is heated by the heater (cartridge heater) 88 to 400° C. to less than 500° C., for example. This causes the reaction between the magnesium in the surface of the mold release layer 100 and the nitrogen gas, forming magnesium nitride ($Mg_3N_2$) 102 on the surface of the area 87*a*.

Setting the content of magnesium included in the mold release agent at 2 wt % to 20 wt % and heating the area 87*a* of the mold surface 87 by the heater (cartridge heater) 88 to, e.g., 400° C. to less than 500° C. to heat the mold release layer 100, as described above, facilitate the formation of the magnesium nitride 102. This results in efficient formation of the magnesium nitride 102. Heating to 400° C. to less than 500° C. allows the reduction in temperature of the atmosphere to less than 700° C. and the maintenance of the durability of the mold 22.

After the formation of the magnesium nitride 102 in the area 87*a* of the mold surface 25, the nitrogen switching valve 53 shown in FIG. 9 is switched to the closed state.

As described with FIGS. 10A and 10B, during the formation of the magnesium nitride 102, the mold release agent including magnesium is first applied to the area 87*a* of the mold surface 87 and then a nitrogen gas is injected into the cavity. Magnesium in the surface of the mold release layer 100 reacts with the nitrogen gas, forming the magnesium nitride 102. Thus, the nitrogen gas reacts only with the magnesium exposed in the surface of the mold release layer 100, of all the magnesium included in the mold release layer 100. This allows the reduction of the forming time of the magnesium nitride 102. In addition, the fact that the nitrogen gas is reacted only with the magnesium exposed in the surface of the mold release layer 100 to form the magnesium nitride 102, allows reduction in the amount of the nitrogen gas used.

As a method of attaching magnesium to the area 87*a* of the mold surface 87, another method of heating and sublimating magnesium and injecting the sublimated gaseous magnesium into the cavity to deposit the gaseous magnesium in the area 87*a* may be conceived.

To adopt this method, however, it is required to provide a heating means for sublimating the magnesium and also a gas injecting means for injecting the sublimated gaseous magnesium into the cavity using an inert gas, for example. This increases the cost of equipment, preventing reduction in cast cost.

In this context, the mold release agent including magnesium is applied to the area 87*a* of the mold surface 87. This eliminates the need for a heating means for sublimating magnesium and a gas injecting means for injecting gaseous magnesium into the cavity.

The application of a mold release agent to the mold surface 87 so as to release a casting from the mold 82 at the completion of the casting process is a general operation step. This application step can be utilized to apply magnesium to the area 87*a* of the mold surface 87, eliminating the need for adding a new step of applying magnesium to the area 87*a* of the mold surface 87. This allows the simplification of the casting process.

Now an example of ST14 shown in FIG. 3 will be described with reference to FIGS. 11A to 12B.

Figure 11A:
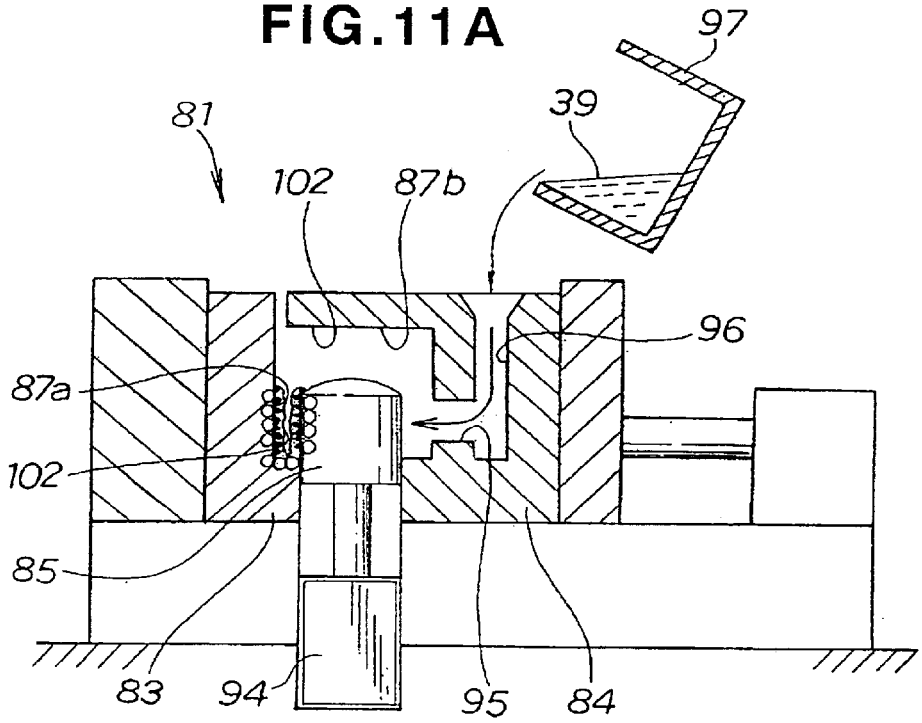
FIGS. 11A and 11B illustrate the supply of molten aluminum into the cavity in the state shown in FIG. 10B and the contact of the surface of the molten aluminum supplied into the cavity with magnesium nitride.

In FIG. 11A, the pouring tank 97 of the casting apparatus body 81 is inclined to supply the molten aluminum 39 in the pouring tank 97 via the pouring gate 96 and the runner 95 into the cavity as shown by an arrow.

The mold release agent is an oil-based mold release agent as in the first embodiment. The use of an oil-based mold release agent prevents the reaction between magnesium and water (oxygen). This allows the formation of magnesium nitride by the injection of a nitrogen gas into the cavity and the reduction of the surface of the molten aluminum 39 with the magnesium nitride to maintain the molten aluminum 39 in good fluidity.

Since the molten aluminum 39 is a kind of viscous fluid as described in the first embodiment, a path with a large section area allows the easy maintenance of good runnability and a path with a small section area or a path with cross section of a small vertical or lateral dimension worsens the runnability. The cavity inevitably has an area causing poor runnability.

Figure 11B:
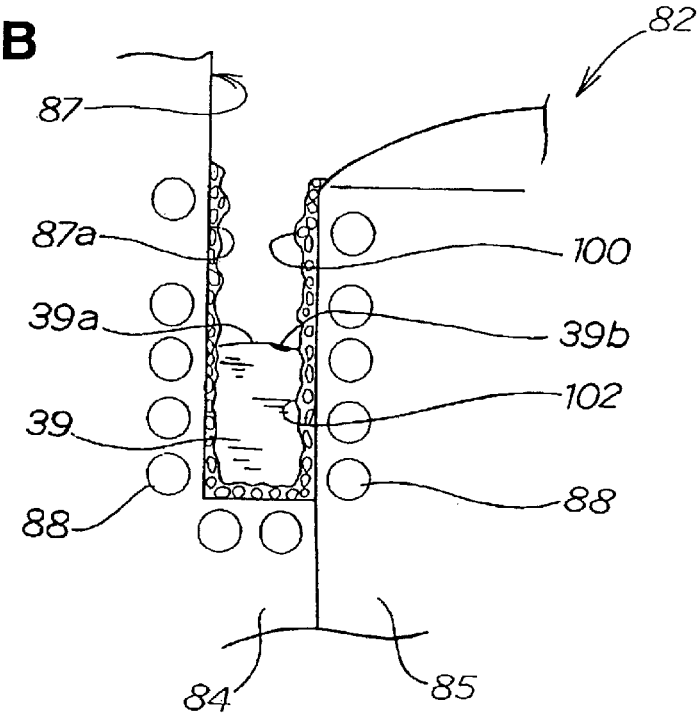

An area of the mold surface 87 forming a large space (an area allowing good runnability) 87*b* allows the smooth flow of the molten aluminum 39 even if an oxide 39*b* is formed on the surface 39*a* of the molten aluminum 39 as shown in FIG. 11B.

The area of the mold surface 87 forming a small space (that is, an area in which the maintenance of good runnability is difficult) 87*a* causes relatively poor flow of the molten aluminum 39, so that the formation of the oxide 39*b* (See FIG. 11B) on the aluminum surface 39*a* makes it difficult to smoothly flow the molten aluminum 39.

To deal with this, the magnesium nitride 103 is formed in the area 87*a* of the mold surface 87 forming a small space to reduce the oxide 39*b* of the molten aluminum 39 using the magnesium nitride 103. The function is described with FIG. 11B.

In FIG. 11B, when the molten aluminum 39 supplied to the cavity reaches the area 87*a* of the mold surface 87, the surface 39*a* of the molten aluminum 39 is brought into contact with the magnesium nitride 102. On the surface 39*a* of the molten aluminum 39, the oxide 39*b* may be formed. If the oxide 39*b* is formed, the reaction between the oxide 39*b* and the magnesium nitride 102 allows the removal of oxygen from the oxide 39*b*. This prevents the formation of an oxide film on the surface 39*a* of the molten aluminum 39, avoiding an increase in the surface tension of the molten aluminum 39. The area 87*a* of the mold surface 87 thus allows the maintenance of the molten aluminum 39 in good runnability.

Figure 12A:
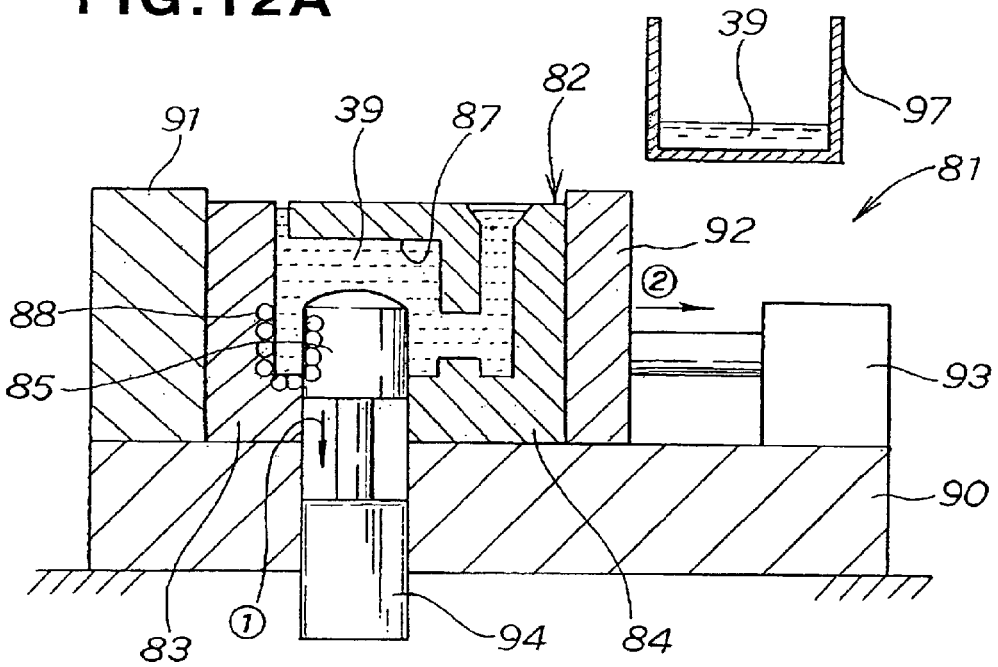
FIGS. 12A and 12B illustrate the supply of a predetermined amount of the molten aluminum into the cavity and the opening of the mold to obtain an aluminum cast.

In FIG. 12A, after a predetermined amount of the molten aluminum 39 is supplied from the pouring tank 97 into the cavity, the pouring tank 97 is returned to a horizontal position. After the molten aluminum 39 solidifies, the elevation member 94 moves down the core 85 as shown by arrow ① and the shift member 93 shifts the movable mold 84 as shown by arrow ②, whereby opening the mold 82.

Figure 12B:
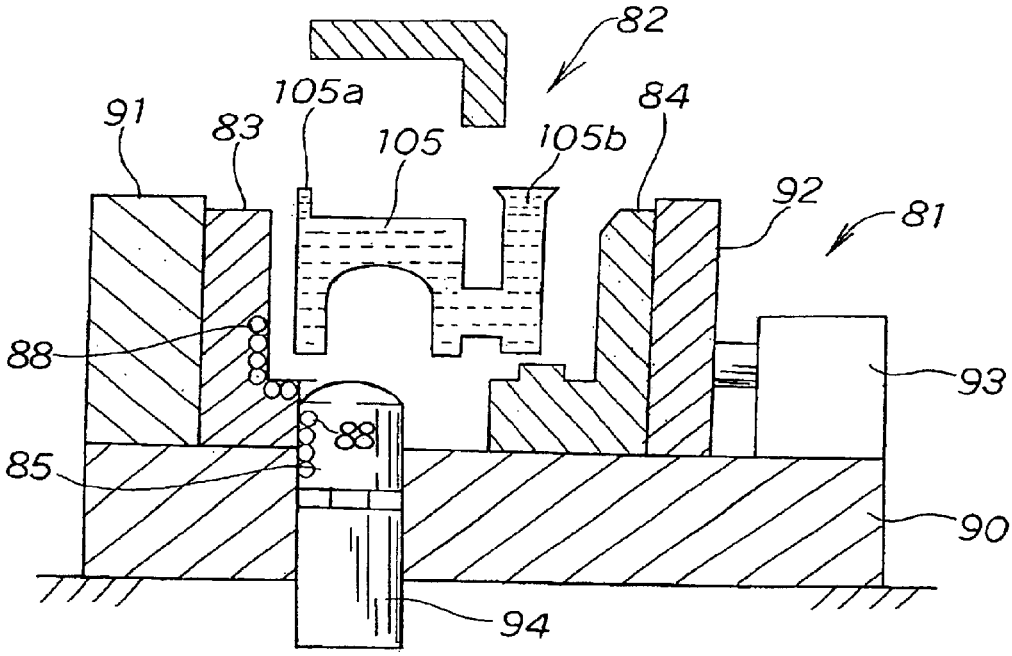

As shown in FIG. 12B, the mold 82 is opened to take out an aluminum casting 105 resulting from the solidification of the molten aluminum 39 (See FIG. 12A). The maintainability of good runnability during pouring allows improvement in quality of the aluminum casting 105. Non-product portions 105*a* and 105*b* are removed from the aluminum casting 105. Then the product portion is processed to provide a cylinder block of an engine.

Now a casting method of the third embodiment of the present invention will be described with reference to FIGS. 13 to 19B.

Figure 13:
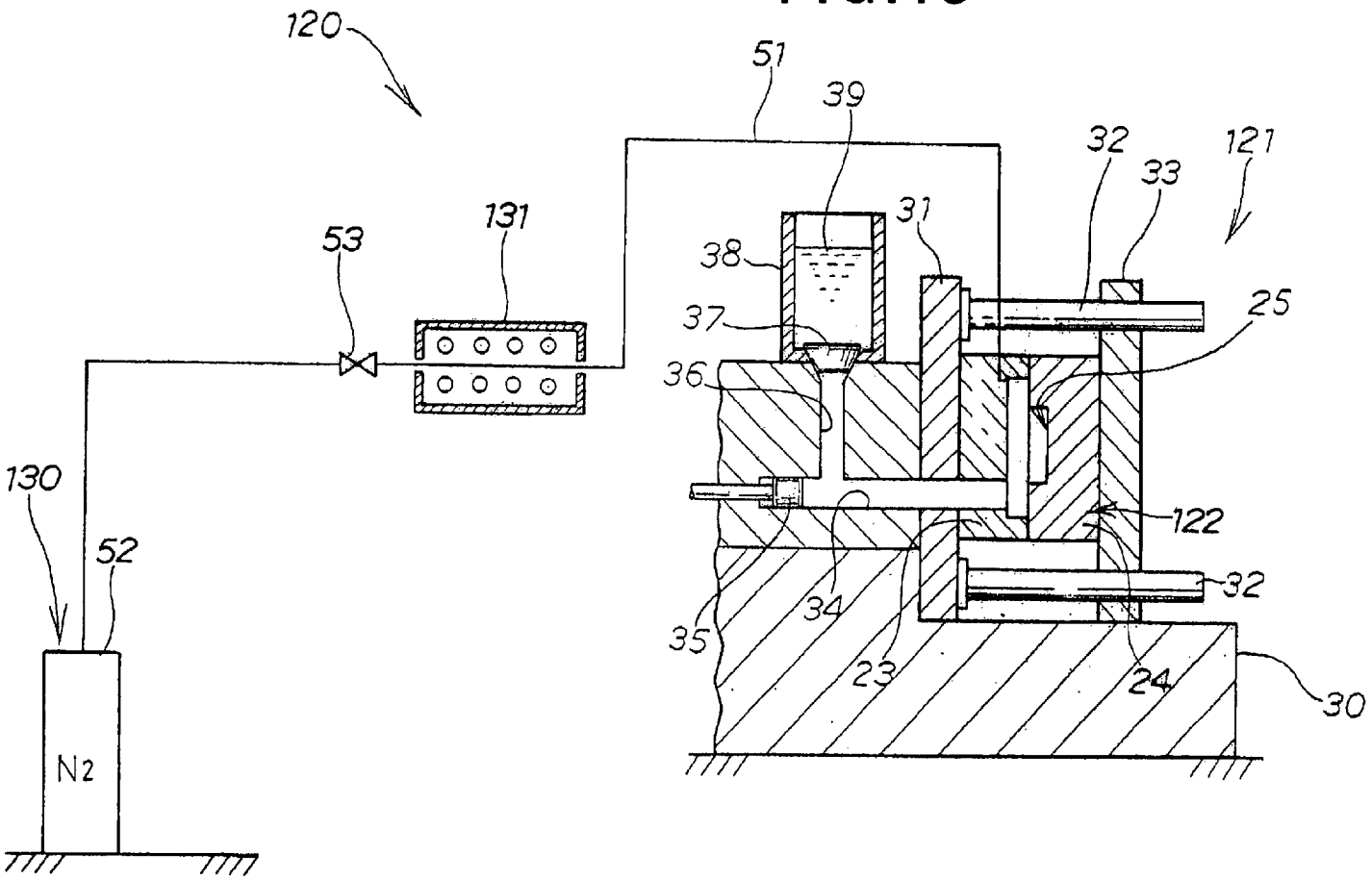
FIG. 13 is a schematic diagram of an aluminum casting apparatus for implementing the aluminum casting method according to the third embodiment of the present invention, illustrating an example of providing a heater for heating a nitrogen gas at a midpoint of a nitrogen gas injection path.

FIG. 13 illustrates the outline of an aluminum casting apparatus for implementing an aluminum casting method according to the third embodiment.

Referring to FIG. 13, an aluminum casting apparatus 120 includes a casting apparatus body 121 having a mold 122 and a nitrogen gas injector 130 for injecting a nitrogen ($N_2$) gas into a cavity formed by a mold surface 25 of the mold 122. The mold surface 25 is a surface formed within a fixed mold 23 and a movable mold 24 as in the first embodiment.

The casting apparatus body 121 of the third embodiment is configured with the heater 27 removed from the mold 22 in the first embodiment. Other components are identical to those of the casting apparatus body 21 as described in the first embodiment. The nitrogen gas injector 130 has a heater 131 at a midpoint of the nitrogen gas injection path 51 of the nitrogen gas injector 50 of the first embodiment. Other components are identical to those of the nitrogen gas injector 50.

The nitrogen gas injector 130 provided with the heater 131 can heat a nitrogen gas flowing through the nitrogen gas injection path 51 to a predetermined temperature (400° C. to less than 500° C., for example).

Figure 14:
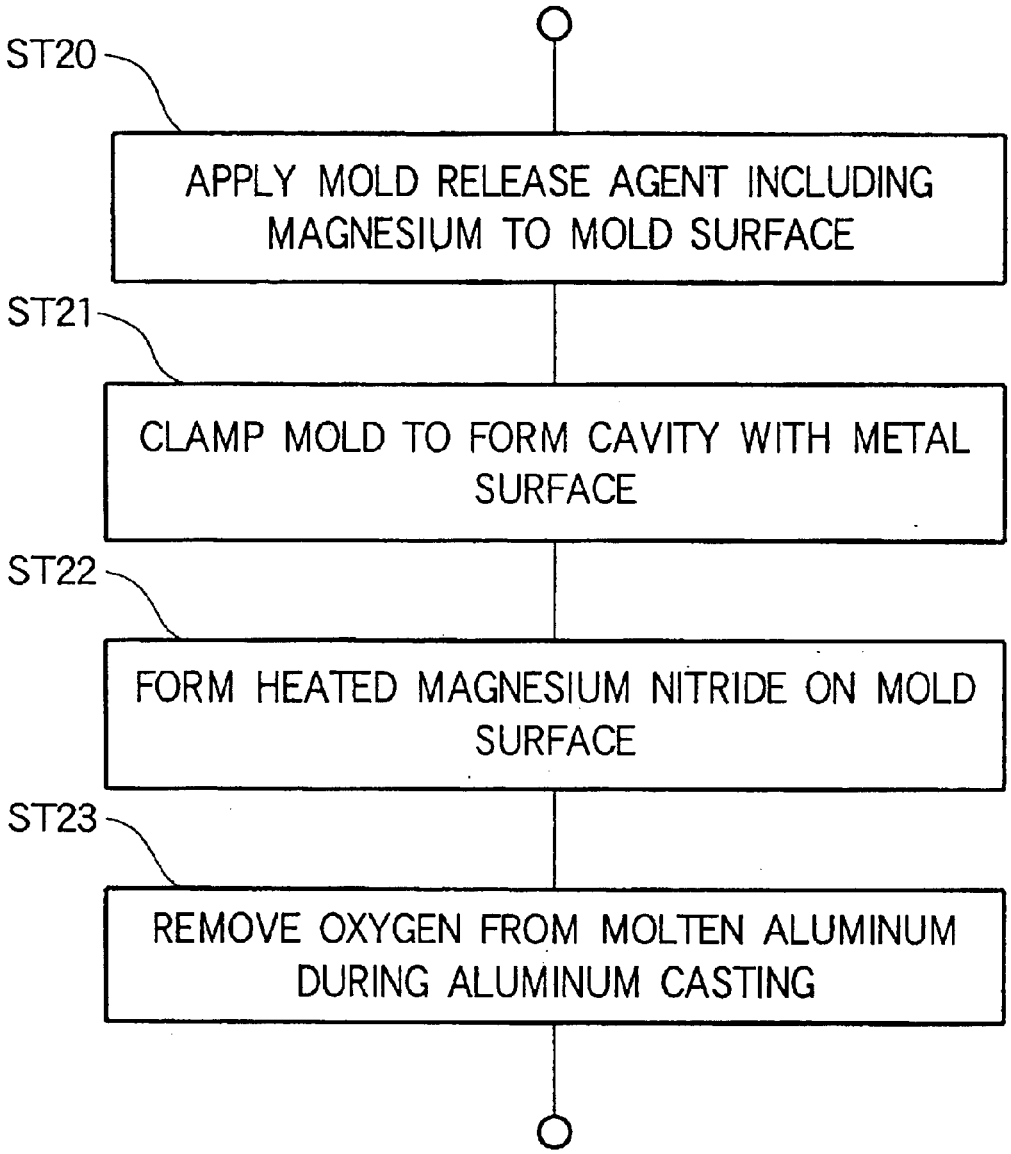
FIG. 14 is a flowchart of the aluminum casting method according to the third embodiment.

FIG. 14 illustrates a flowchart explaining the aluminum casting method of the third embodiment.

ST20: With a mold opened, a mold release agent including magnesium is applied to a mold surface to form a cavity.

ST21: The mold is clamped to form the cavity with the mold surface to which the mold release agent is applied.

ST22: A nitrogen gas heated is injected into the cavity. The nitrogen gas is reacted with the magnesium, forming magnesium nitride on the mold surface.

ST23: Molten aluminum is supplied to the cavity in which the magnesium nitride is formed, with the surface of the molten aluminum being reduced by the magnesium nitride, to form an aluminum casting inside the cavity.

Now steps ST20 to ST23 of the aluminum casting method according to the third embodiment will be described with reference to FIGS. 15 to 19B.

First at ST20, the movable mold 24 of the mold 122 shown in FIG. 13 is shifted as shown by an arrow to open the mold 22. Then the mold release agent is applied to the mold surface 25 (an area 25*a* corresponding to a thin-section part of a casting and another area 25*b* of the casting) of each of the fixed mold 23 and the movable mold 24.

Figure 15:
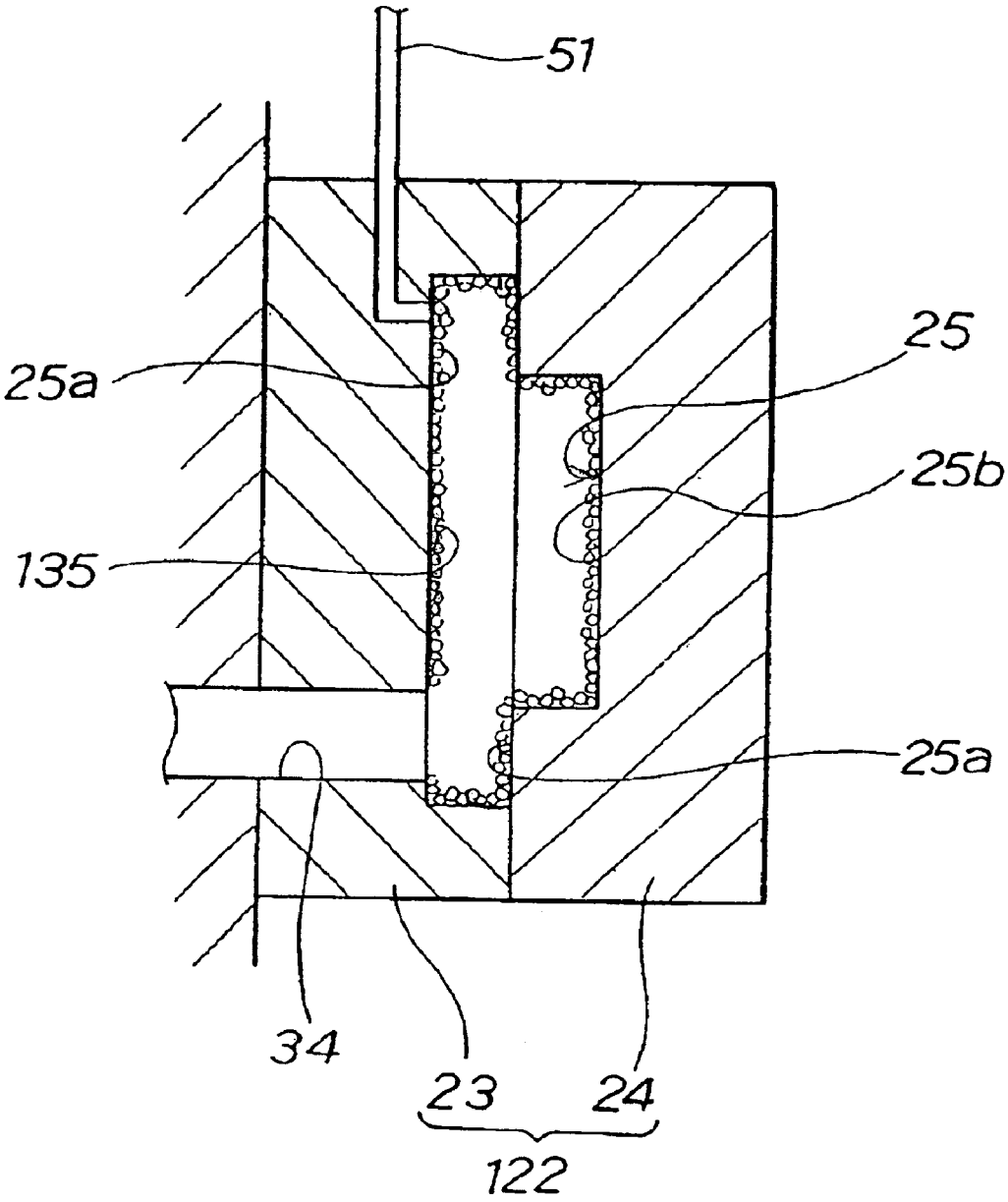
FIG. 15 illustrates a mold clamped with a mold release agent applied to the entire surface thereof by the aluminum casting method according to the third embodiment.

FIG. 15 illustrates an example of ST20 and ST21 shown in FIG. 14.

The mold release agent is applied to the mold surface 25 to form a mold release layer 135. Then the mold 82 is clamped to form the cavity with the mold surface 25.

The mold release agent applied to the mold surface 25 is an oil-based mold release agent including 2 wt % to 20 wt % of powder magnesium. The magnesium content is preferably 5 wt % to 10 wt %. The reason why the magnesium content is 2 wt % to 20 wt %, and preferably is 5 wt % to 10 wt %, is the same as in the first embodiment and will not be described.

Figure 16:
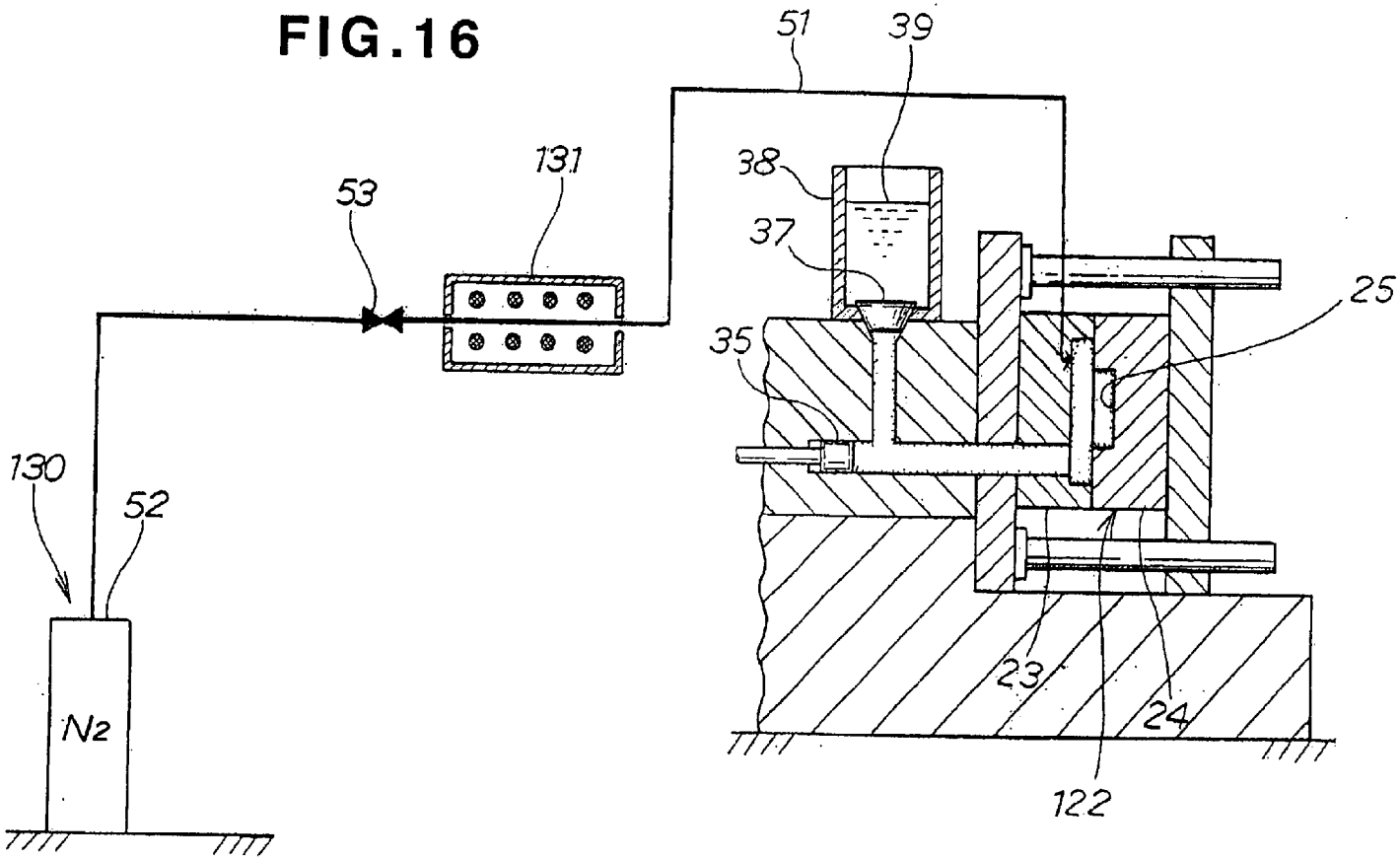
FIG. 16 illustrates the heating of a nitrogen gas with the heater shown in FIG. 13 and the injection of the heated nitrogen gas into the cavity.
Figure 17:
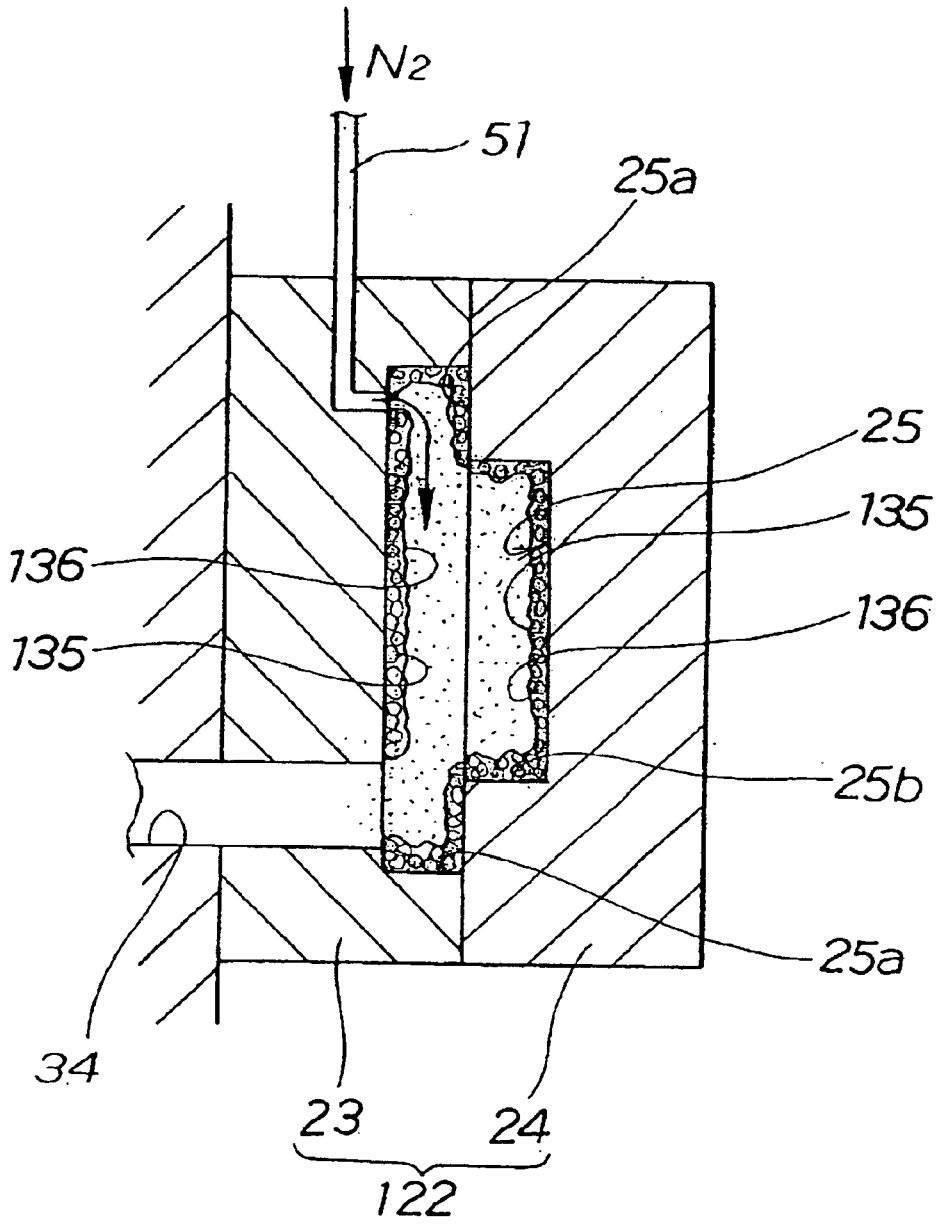
FIG. 17 illustrates the formation of magnesium nitride on the surface of a mold release layer due to the reaction between magnesium on the surface of the mold release layer and a nitrogen gas.

FIGS. 16 and 17 illustrate an example of ST22 shown in FIG. 14.

As shown in FIG. 16, the heater 131 of the nitrogen gas injector 130 is heated. In this state, a nitrogen gas switching valve 53 is switched to an open state. The switching of the nitrogen gas switching valve 53 to the open state provides the flow of a nitrogen gas in a nitrogen gas cylinder 52 into the nitrogen gas injection path 51. The nitrogen gas in the nitrogen gas injection path 51 is heated by the heater 131. The heated nitrogen gas is injected into the cavity via the nitrogen gas injection path 51.

Thus heating the nitrogen gas separately by the heater 131 allows the heating of the nitrogen gas flowing through the nitrogen gas injection path 51 to a predetermined temperature (400° C. to less than 500° C., for example).

As shown in FIG. 17, the nitrogen gas injected into the cavity is heated to a predetermined temperature (400° C. to less than 500° C., for example). This causes the reaction between the magnesium in the surface of the mold release layer 135 and the nitrogen gas, forming magnesium nitride ($Mg_3N_2$) 136 on the surface of the mold release layer 135.

Setting the content of magnesium included in the mold release agent at 2 wt % to 20 wt % and heating the nitrogen gas by the heater 131 shown in FIG. 16 to, e.g., 400° C. to less than 500° C. to heat the mold release layer 135, as described above, facilitate the formation of the magnesium nitride 136. This results in efficient formation of the magnesium nitride 136. Heating to 400° C. to less than 500° C. allows the reduction in temperature of the atmosphere to less than 700° C. and the maintenance of durability of the mold 122. After the formation of the magnesium nitride 136 on the mold release layer 135, the nitrogen gas switching valve 53 shown in FIG. 16 is switched to the closed state.

As described with FIGS. 15 and 17, during the formation of the magnesium nitride 136, the mold release agent including magnesium is first applied to the mold surface 25 and then a nitrogen gas is injected into the cavity. Magnesium in the surface of the mold release layer 135 reacts with the nitrogen gas, forming the magnesium nitride 136. Thus, the nitrogen gas is reacted only with the magnesium exposed in the surface of the mold release layer 135, of all the magnesium included in the mold release layer 135. This enables shortening the forming time of the magnesium nitride 136. The reaction of the nitrogen gas only with the magnesium exposed in the surface of the mold release layer 135 allows the formation of the magnesium nitride 136, reducing the amount of the nitrogen gas used.

As a method of attaching magnesium to the mold surface 25, another method of heating and sublimating magnesium and injecting the sublimated gaseous magnesium into the cavity to deposit the gaseous magnesium on the mold surface 25 may be conceived.

To adopt this method, however, it is required to provide a heating means for sublimating the magnesium and also a gas injecting means for injecting the sublimated gaseous magnesium into the cavity using an inert gas, for example. This increases the cost of equipment, preventing reduction in cast cost.

In this context, the mold release agent including magnesium is applied to the mold surface 25. This eliminates the need for a heating means for sublimating magnesium and a gas injecting means for injecting gaseous magnesium into the cavity.

The application of a mold release agent to the mold surface 25 so as to release a casting from the mold 122 at the completion of the casting process is a general operation step. This application step can be utilized to apply magnesium to the mold surface 25, eliminating the need for adding a new step of applying magnesium to the mold surface 25. This allows simplification of the casting process.

FIGS. 18A to 19B illustrate an example of ST23 of the aluminum casting method shown in FIG. 14.

Figure 18A:
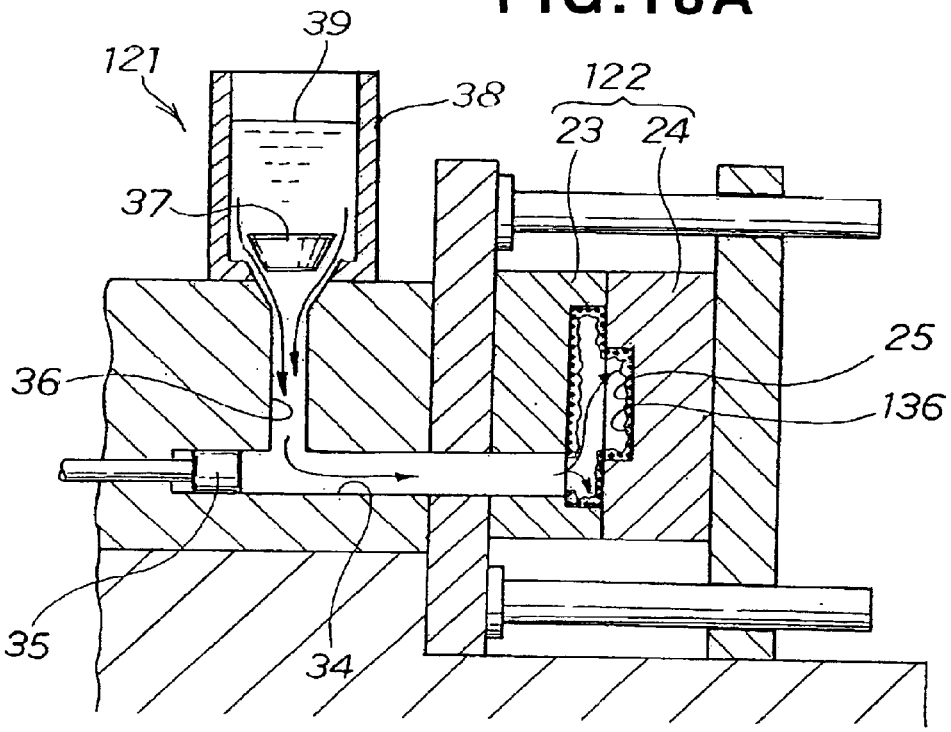
FIGS. 18A and 18B illustrate the supply of molten aluminum into the cavity in the state shown in FIG. 17 and the contact of the surface of the molten aluminum within the cavity with the magnesium nitride.

As shown in FIG. 18A, a tenon 37 of the casting apparatus body 121 is controlled to open a pouring gate 36, thereby supplying the molten aluminum 39 in a pouring tank 38 via the pouring gate 36 and a runner 34 into the cavity as shown by arrows.

The mold release agent is an oil-based mold release agent as in the first embodiment. The use of an oil-based mold release agent prevents the reaction between magnesium and water (oxygen). This allows the formation of magnesium nitride by injecting a nitrogen gas into the cavity and the reduction of the surface of the molten aluminum 39 with the magnesium nitride, maintaining the molten aluminum 39 in good fluidity.

Figure 18B:
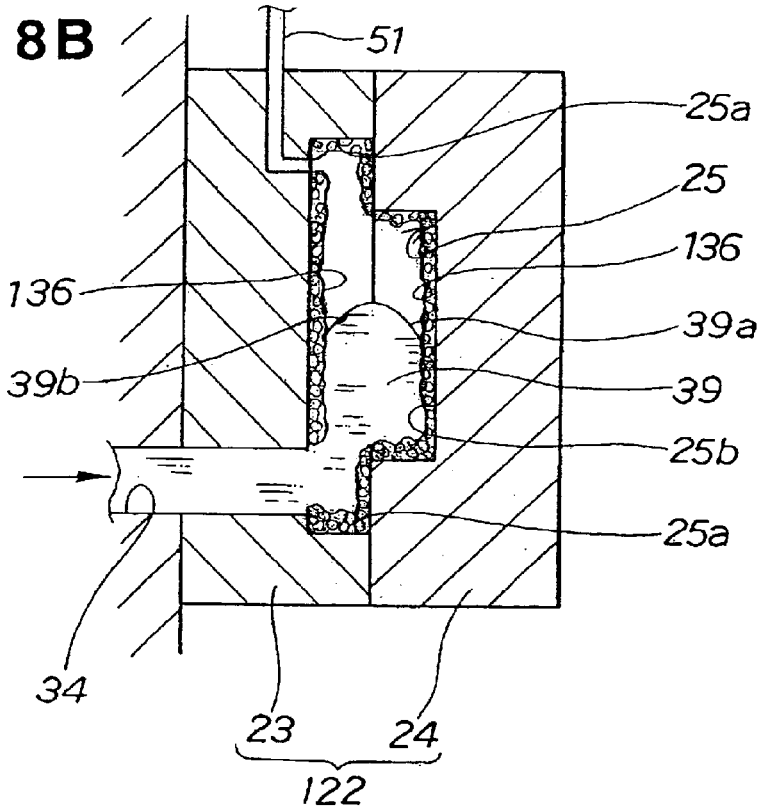

In FIG. 18B, the surface 39*a* of the molten aluminum 39 supplied to the cavity is brought into contact with the magnesium nitride 136. On the surface 39*a* of the molten aluminum 39, an oxide 39*b* may be formed. If the oxide 39*b* is formed, the reaction between the oxide 39*b* and the magnesium nitride 136 allows the removal of oxygen from the oxide 39*b*. This prevents the formation of an oxide film on the surface 39*a* of the molten aluminum 39, avoiding an increase in the surface tension of the molten aluminum 39. Thus the runnability of the molten aluminum 39 into the cavity can be maintained in good conditions.

The area of the mold surface 25 forming a small space (that is, an area in which the maintenance of good runnability is difficult) 25*a* especially causes relatively poor flow of the molten aluminum 39, so that the formation of the oxide 39*b* on the aluminum surf ace 39*a* makes it difficult to smoothly flow the molten aluminum 39. Thus the fact that good runnability can be secured in the area 25*a* of the mold surface 25 results in further increased effects.

Figure 19A:
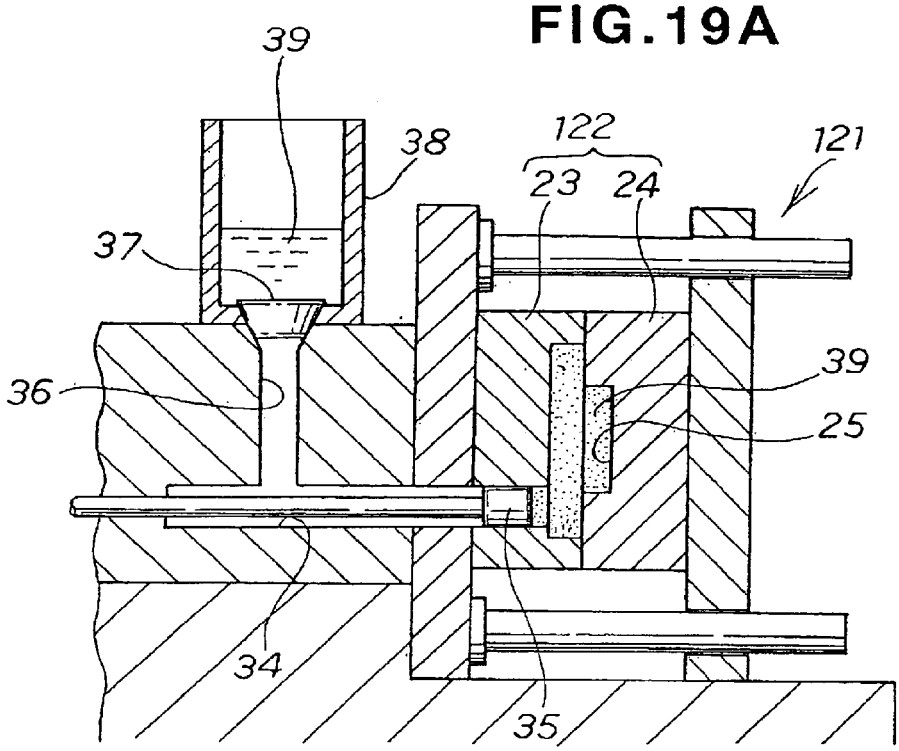
FIGS. 19A and 19B illustrate the supply of a predetermined amount of the molten aluminum into the cavity and the opening of the mold to take out solidified aluminum casting.

In FIG. 19A, after a predetermined amount of the molten aluminum 39 is supplied from the pouring tank 38 into the cavity, the pouring gate 36 is closed with the tenon 37. In this state, a plunger 35 is pushed toward the cavity to charge the molten aluminum 39 into the cavity.

Figure 19B:
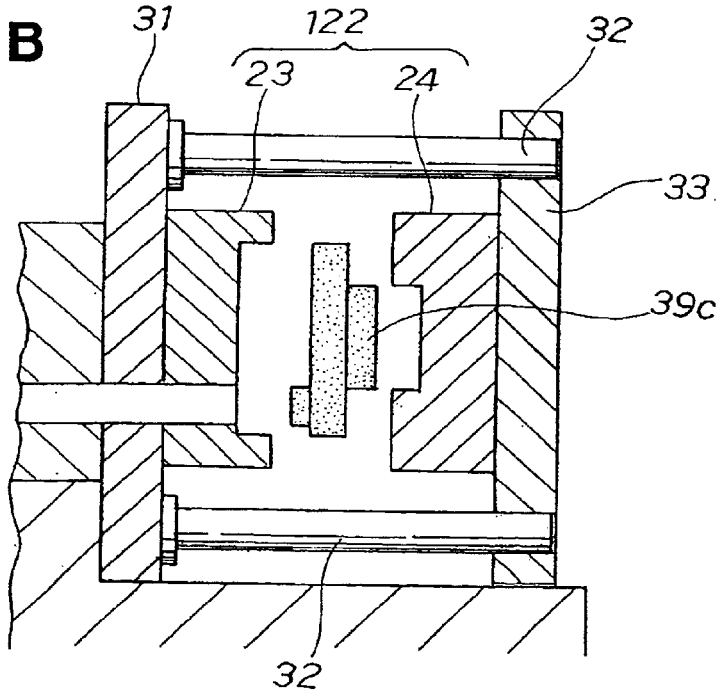

Next, as shown in FIG. 19B, the mold 122 is opened to take out an aluminum casting 39*c* resulting from the solidification of the molten aluminum 39 (See FIG. 19A). The maintainability of good runnability during pouring allows improvement in quality of the aluminum casting 39*a*. The aluminum casting 39*c* is processed to provide the brake disc 10 shown in FIG. 1.

Now a casting method according to a fourth embodiment will be described with reference to FIGS. 20 to 23B.

FIG. 20 illustrates the outline of an aluminum casting apparatus for implementing the aluminum casting method according to the fourth embodiment.

In FIG. 20, an aluminum casting apparatus 140 includes a casting apparatus body 141 having a mold 142 and a nitrogen gas injector 130 for injecting a nitrogen ($N_2$) gas into a cavity formed by a mold surface 87 of the mold 142. The mold surface 87 is a surface formed by a fixed mold 83, a movable mold 84 and a core 85. The casting apparatus body 141 is configured with the heater 88 removed from the mold 142 in the second embodiment. Other components are identical to those of the casting apparatus body 81 in the second embodiment.

Now an example of implementing a casting method of the fourth embodiment using the aluminum casting apparatus 140 will be described with reference to FIG. 14 and FIGS. 20 to 23B.

First, step ST20 shown in FIG. 14 will be described.

The movable mold 84 of the mold 142 shown in FIG. 20 is shifted to open the mold 142. Then, a mold release agent is applied to the mold surface 87 of the fixed and movable molds 83 and 84.

FIG. 21A illustrates step ST21 shown in FIG. 14. FIG. 21B illustrate step ST22 shown in FIG. 14.

As shown in FIG. 21A, the mold release agent is applied to the mold surface 87 (an area 87*a* forming a thin-section part of a cast and an area 87*b* forming the other area of the cast) to form a mold release layer 145 on the mold surface 87. Then the mold 142 is clamped to form the cavity with the mold surface 87.

The mold release agent applied to the mold surface 87 is an oil-based mold release agent including 2 wt % to 20 wt % of powder magnesium. The magnesium content is preferably 5 wt % to 10 wt %. The reason why the magnesium content is 2 wt % to 20 wt %, and preferably is 5 wt % to 10 wt %, is the same as in the first embodiment and will not be described.

As shown in FIG. 20, the heater 131 of the nitrogen gas injector 130 is heated. In this state, a nitrogen switching valve 53 is switched to an open state. Switching the nitrogen switching valve 53 to the open state provides the flow of a nitrogen gas in a nitrogen gas cylinder 52 into a nitrogen gas injection path 51. The nitrogen gas in the nitrogen gas injection path 51 is thus heated by the heater 131. The heated nitrogen gas is injected into the cavity formed with the mold surface 87 via the nitrogen gas injection path 51.

Thus the nitrogen gas can be separately heated by the heater 131 to efficiently heat the nitrogen gas flowing through the nitrogen injection path 51 to a predetermined temperature (400° C. to less than 500° C., for example).

In FIG. 21B, the nitrogen gas injected into the cavity is heated to a predetermined temperature (400° C. to less than 500° C., for example). This causes the reaction between the magnesium in the surface of the mold release layer 145 and the nitrogen gas, forming magnesium nitride ($Mg_3N_2$) 146 on the surface of the mold release layer 145.

Setting the content of magnesium included in the mold release agent at 2 wt % to 20 wt % and heating the nitrogen gas by the heater 131 shown in FIG. 20 to, e.g., 400° C. to less than 500° C. to heat the mold release layer 145, as described above, facilitate the formation of magnesium nitride 146. This results in efficient formation of the magnesium nitride 146. Heating to 400° C. to less than 500° C. allows the reduction in temperature of the atmosphere to less than 700° C. and the maintenance of the durability of the mold. After the formation of the magnesium nitride 146 on the surface of the mold release layer 145, the nitrogen gas switching valve 53 shown in FIG. 20 is switched to the closed state.

As described with FIGS. 21A and 21B, during the formation of the magnesium nitride 146, the mold release agent including magnesium is first applied to the mold surface 87 and then a nitrogen gas is injected into the cavity. Magnesium in the surface of the mold release layer 145 reacts with the nitrogen gas, forming the magnesium nitride 146. Thus, the nitrogen gas is reacted only with the magnesium exposed in the surface of the mold release layer 145, of all the magnesium included in the mold release layer 145. This allows the reduction of the forming time of the magnesium nitride 146. In addition, the fact that the nitrogen gas is reacted only with the magnesium exposed in the surface of the mold release layer 145 to form the magnesium nitride 146 allows reduction in the amount of the nitrogen gas used.

As a method of attaching magnesium to the mold surface 87, another method of heating and sublimating magnesium and injecting the sublimated gaseous magnesium into the cavity to deposit the gaseous magnesium on the mold surface 87 may be conceived.

To adopt this method, however, it is required to provide a heating means for sublimating the magnesium and also a gas injecting means for injecting the sublimated gaseous magnesium into the cavity using an inert gas, for example. This increases the cost of equipment, preventing reduction in cast cost.

In this context, the mold release agent including magnesium is applied to the mold surface 87. This eliminates the need for a heating means for sublimating magnesium and a gas injecting means for injecting gaseous magnesium into the cavity.

The application of a mold release agent to the mold surface 87 so as to release a casting from the mold 142 at the completion of the casting process is a general operation step. This application step can be utilized to apply magnesium to the mold surface 87, eliminating the need for adding a new step of applying magnesium to the mold surface 87. This allows the simplification of the casting process.

FIGS. 22A to 23B illustrate step ST 23 shown in FIG. 14.

As shown in FIG. 22A, a pouring tank 97 of the casting apparatus body 141 is inclined to supply the molten aluminum 39 in the pouring tank 97 via the pouring gate 96 and the runner 95 to the cavity as shown by arrows.

The mold release agent is an oil-based mold release agent as in the first embodiment. The use of an oil-based mold release agent prevents the reaction between magnesium and water (oxygen). This allows the formation of magnesium nitride by the injection of a nitrogen gas into the cavity and the reduction of the surface of the molten aluminum 39 with the magnesium nitride, maintaining the molten aluminum 39 in good fluidity.

In FIG. 22B, the surface 39*a* of the molten aluminum 39 supplied into the cavity is brought into contact with the magnesium nitride 146. On the surface 39*a* of the molten aluminum 39, an oxide 39*b* may be formed. If the oxide 39*b* is formed, the reaction between the oxide 39*b* and the magnesium nitride 146 allows the removal of oxygen from the oxide 39*b*. This prevents the formation of an oxide film on the surface 39*a* of the molten aluminum 39, avoiding an increase in the surface tension of the molten aluminum 39. Thus the runnability of the molten aluminum 39 into the cavity can be maintained in good conditions.

The area of the mold surface 87 forming a small space (that is, an area in which the maintenance of good runnability is difficult) 87*a* especially causes relatively poor flow of the molten aluminum 39, so that the formation of the oxide 39*b* on the aluminum surface 39*a* makes it difficult to smoothly flow the molten aluminum 39. The fact that good runnability can be secured in the area 87*a* of the mold surface 87 thus provides further increased effects.

In FIG. 23A, after a predetermined amount of the molten aluminum 39 is supplied from the pouring tank 97 into the cavity, the pouring tank 97 is returned to a horizontal position. After the molten aluminum 39 solidifies, an elevation member 94 moves down the core 85 as shown by arrow ③ and a shift member 93 shifts the movable mold 84 as shown by arrow ④, whereby opening the mold 142.

As shown in FIG. 238, the mold 142 is opened to take out an aluminum casting 105 resulting from the solidification of the molten aluminum 39 (See FIG. 23A). The maintainability of good runnability during pouring allows improvement in quality of the aluminum casting 105. Non-product portions 105*a* and 105*b* are removed from the aluminum casting 105. Then the product portion is processed to provide a cylinder block of an engine.

The first and second embodiments have been described using the examples of applying the mold release agent to the area 25*a* of the mold surface 25 and the area 87*a* of the mold surface 87 and heating the areas 25*a*, 87*a*, but are not limited to the examples. The mold release agent may be applied to the entire areas of the mold surfaces 25, 87. In this case, the entire areas of the mold surfaces 25, 87 may be heated or only the areas 25*a*, 87 may be heated.

The aluminum casting method in the above-described embodiments is applicable to aluminum alloys including silicon, nickel or copper, for example, or pure aluminum.

Industrial Applicability

For forming magnesium nitride on a mold surface, a mold release agent including magnesium is applied in advance to the mold surface. Then a nitrogen gas is injected into a cavity to cause reaction between magnesium in the surface of the mold release agent and the, nitrogen gas and form magnesium nitride. This allows the reaction of only the magnesium exposed in the surface of the mold release agent with the nitrogen gas, reducing the forming time of the magnesium nitride, reducing the amount of nitrogen gas used, and thereby reducing the casting production cost. This is suitable for the production of brake discs and cylinder blocks, for example, and is useful especially in the automobile industry.

What is claimed is:

1. An aluminum casting method, comprising the steps of:

applying a mold release agent including magnesium to a mold surface;

forming a cavity with said mold surface to which said mold release agent is applied;

injecting a nitrogen gas into said cavity to react said nitrogen gas with magnesium, thereby forming magnesium nitride on said mold surface; and supplying molten aluminum to said cavity in which said magnesium nitride is formed, with an oxide on a surface of said molten aluminum being reduced by said magnesium nitride, to make an aluminum casting inside said cavity.

2. The method of claim 1, wherein said mold release agent is an oil-based mold release agent.

3. The method of claim 1, wherein a content of said magnesium included in said mold release agent is 2 wt % to 20 wt %.

4. The method of claim 1, wherein an area of said mold surface to which said mold release agent is applied is at least the area that causes poor runnability.

5. The method of claim 1, comprising the further step of heating said mold surface to a predetermined temperature.

6. The method of claim 1, wherein the cavity defines a first portion and a second portion, said second portion having a cross-sectional dimension that is relatively smaller than a cross-sectional dimension of said first portion, wherein said mold surface corresponds at least to said second portion, comprising the further step of heating said mold surface prior to supplying molten aluminum to said cavity.

7. The method of claim 6, wherein said mold release agent is an oil-based mold release agent.

8. The method of claim 6, wherein a content of said magnesium included in said mold release agent is 2 wt % to 20 wt %.

9. The method of claim 6, wherein an area of said mold surface to which said mold release agent is applied is at least the area that causes poor runnability.

* * * * *